US010095166B2

(12) United States Patent
Okamoto et al.

(10) Patent No.: US 10,095,166 B2
(45) Date of Patent: Oct. 9, 2018

(54) FIXING DEVICE AND IMAGE FORMING APPARATUS

(71) Applicants: Masami Okamoto, Kanagawa (JP); Keisuke Kubota, Kanagawa (JP); Seiji Saitoh, Kanagawa (JP); Shuutaroh Yuasa, Kanagawa (JP); Yuuta Kanda, Kanagawa (JP); Fumihiro Hirose, Kanagawa (JP); Kensuke Yamaji, Kanagawa (JP)

(72) Inventors: Masami Okamoto, Kanagawa (JP); Keisuke Kubota, Kanagawa (JP); Seiji Saitoh, Kanagawa (JP); Shuutaroh Yuasa, Kanagawa (JP); Yuuta Kanda, Kanagawa (JP); Fumihiro Hirose, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/602,407

(22) Filed: May 23, 2017

(65) Prior Publication Data

US 2017/0357197 A1 Dec. 14, 2017

(30) Foreign Application Priority Data

Jun. 10, 2016 (JP) ..... 2016-116123

(51) Int. Cl.
*G03G 15/20* (2006.01)

(52) U.S. Cl.
CPC ..... *G03G 15/2067* (2013.01); *G03G 15/2089* (2013.01); *G03G 2215/2032* (2013.01)

(58) Field of Classification Search
CPC ..... G03G 15/2039; G03G 15/2042; G03G 15/2053; G03G 15/2017; G03G 15/2064
(Continued)

(56) References Cited

U.S. PATENT DOCUMENTS 5,745,820 A * 4/1998 Iwakura ..... G03G 15/167 399/303
2011/0222879 A1* 9/2011 Okamoto ..... G03G 15/2032 399/44

(Continued)

FOREIGN PATENT DOCUMENTS

JP 2003-005566 1/2003
JP 2015-018906 1/2015

OTHER PUBLICATIONS

Translation of Kurotaka (JP 2003-005566 A) listed in the IDS, publication date: Jan. 8, 2003.*

(Continued)

*Primary Examiner* — Walter L Lindsay, Jr.
*Assistant Examiner* — Frederick Wenderoth
(74) *Attorney, Agent, or Firm* — Oblon, McClelland, Maier & Neustadt, L.L.P.

(57) ABSTRACT

A fixing device includes a separator disposed downstream from a nip former in a recording medium conveyance direction and isolated from a pressure rotator via a fixing belt. The separator stretches the fixing belt. A presser is interposed between a fixing nip formed between the living belt and the pressure rotator and an upstream end of the separator in a rotation direction of the fixing belt. The presser comes into contact with an inner circumferential surface of the fixing belt to press the fixing belt against the pressure rotator. A pressure adjuster, contacting the pressure rotator, changes a pressing position of the pressure rotator relative to the fixing belt to adjust pressure exerted from the pressure rotator to the fixing belt. A presser position adjuster, contacting the presser, changes a presser position of the presser relative to the fixing belt according to the pressing position of the pressure rotator.

17 Claims, 18 Drawing Sheets

(58) Field of Classification Search
USPC ..... 399/67
See application file for complete search history.

(56) References Cited

U.S. PATENT DOCUMENTS

| | | | | |
|---|---|---|---|---|
| 2011/0222926 | A1 | 9/2011 | Ueno et al. | |
| 2011/0311284 | A1 | 12/2011 | Seo et al. | |
| 2012/0044516 | A1 | 2/2012 | Hirose et al. | |
| 2012/0207523 | A1 | 8/2012 | Ueno et al. | |
| 2013/0236225 | A1 | 9/2013 | Ogawa et al. | |
| 2013/0251422 | A1 | 9/2013 | Iwaya et al. | |
| 2014/0086608 | A1* | 3/2014 | Murakami ..... | G03G 15/2085 399/67 |
| 2015/0253708 | A1 | 9/2015 | Hirose et al. | |
| 2015/0261154 | A1 | 9/2015 | Nozawa et al. | |
| 2016/0070218 | A1 | 3/2016 | Hirose et al. | |
| 2016/0139549 | A1 | 5/2016 | Nozawa et al. | |
| 2016/0306306 | A1 | 10/2016 | Nozawa et al. | |

OTHER PUBLICATIONS

Translation of Tsukamura (JP 07097083 A) listed in the IDS, publication date: Apr. 11, 1995.*
U.S. Appl. No. 15/447,600, filed Mar. 2, 2017.
U.S. Appl. No. 15/447,666, filed Mar. 2, 2017.
U.S. Appl. No. 15/452,877, filed Mar. 6, 2017.
U.S. Appl. No. 15/444,946, filed Feb. 28, 2017.

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application No. 2016-116123, filed on Jun. 10, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium hearing a toner image is conveyed. As the recording medium hearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing belt that endless and rotatable in a rotation direction and a nip former stretching the fixing belt. A pressure rotator presses against the nip former via the fixing belt to from a fixing nip between the fixing belt and the pressure rotator, through which a recording medium bearing a toner image is conveyed. A separator is disposed downstream from the nip former in a recording medium conveyance direction and isolated from the pressure rotator via the fixing belt. The separator stretches the fixing belt. A presser is interposed between an exit of the fixing nip and an upstream end of the separator in the rotation direction of the fixing belt. The presser comes into contact with an inner circumferential surface of the fixing belt to press the fixing belt against the pressure rotator. A pressure adjuster, contacting the pressure rotator, changes a pressing position of the pressure rotator relative to the fixing belt to adjust pressure exerted from the pressure rotator to the fixing belt. A presser position adjuster, contacting the presser, changes a presser position of the presser relative to the fixing belt according to the pressing position of the pressure rotator.

The specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which the recording medium bearing the toner image is conveyed. A separator is disposed downstream from the nip former in the recording medium conveyance direction and isolated from the pressure rotator via the fixing belt. The separator stretches the fixing belt. A presser is interposed between an exit of the fixing nip and an upstream end of the separator in the rotation direction of the fixing belt. The presser comes into contact with an inner circumferential surface of the fixing belt to press the fixing belt against the pressure rotator. A pressure adjuster, contacting the pressure rotator, changes a pressing position of the pressure rotator relative to the fixing belt to adjust pressure exerted from the pressure rotator to the fixing belt. A presser position adjuster, contacting the presser, changes a presser position of the presser relative to the fixing belt according to the pressing position of the pressure rotator.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
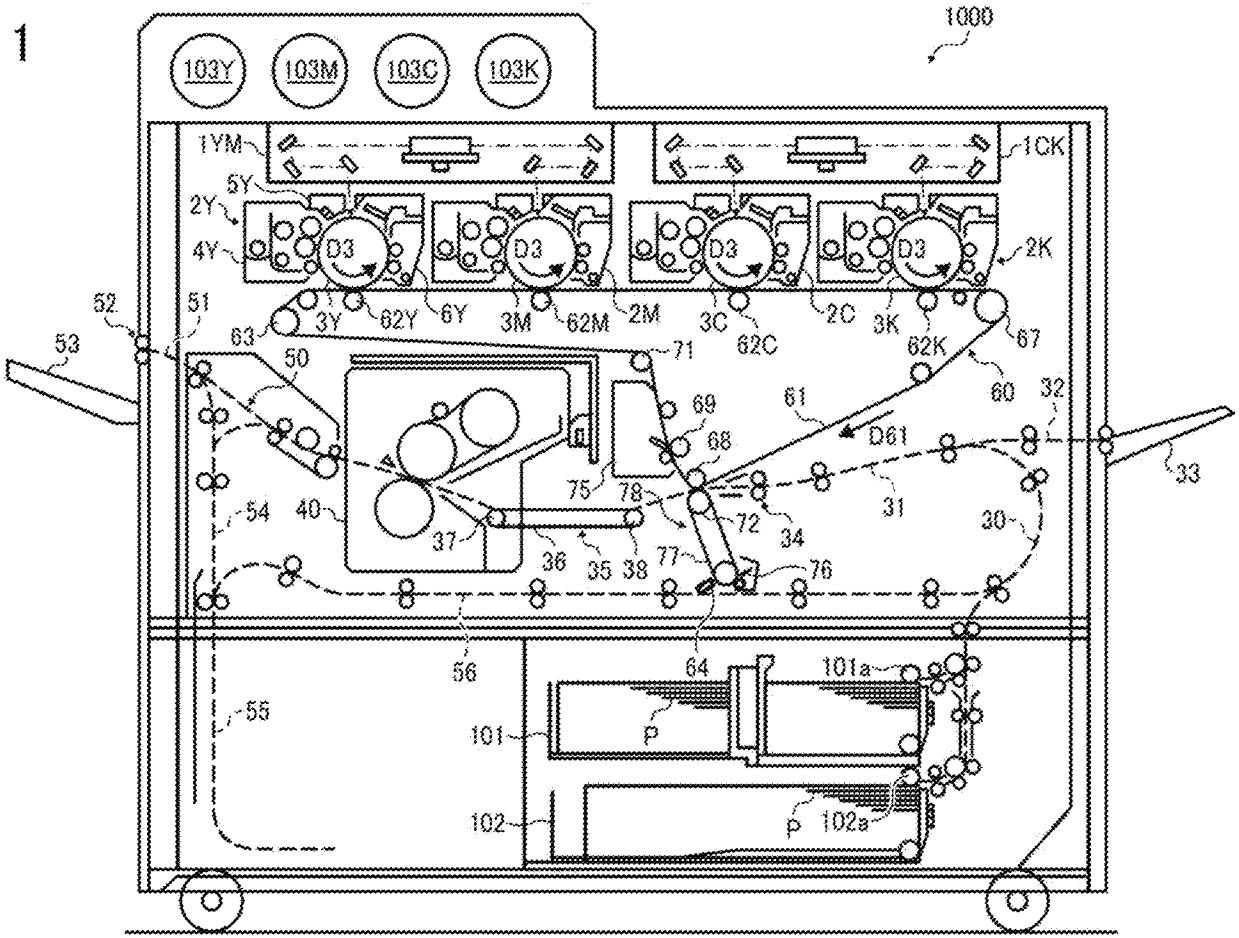
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an exemplary embodiment is explained.

FIG. 1 is a schematic vertical cross-sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1000 is a color printer that forms a color toner image on a recording medium by electrophotography. Alternatively, the image forming apparatus 1000 may be a monochrome printer that forms a monochrome toner image on a recording medium.

Referring to FIG. 1, a description is provided of a construction of the image forming apparatus 1000.

The image forming apparatus 1000 includes four image forming units 2Y, 2M, 2C, and 2K that form yellow (Y), magenta (M), cyan (C), and black (K) toner images, respectively. The image forming apparatus 1000 employs a tandem system in which the four image forming units 2Y, 2M, 2C, and 2K are aligned in a rotation direction D61 of an intermediate transfer belt 61 serving as an endless belt that bears toner images as described below.

The image forming apparatus 1000 further includes a feeding path 30, a pre-transfer conveyance path 31, a bypass feeding path 32, a bypass tray 33, a registration roller pair 34, a conveyance belt unit 35, a fixing device 40, a conveyance switch device 50, an output path 51, an output roller pair 52, and an output tray 53. The image forming apparatus 1000 further includes two optical writing units 1YM and 1CK, a primary transfer unit 60, a secondary transfer unit 78, a first paper tray 101, and a second paper tray 102.

The image forming units 2Y, 2M, 2C, and 2K include photoconductors 3Y, 3M, 3C, and 3K, respectively, each of which is drum-shaped and serves as a latent image bearer that bears an electrostatic latent image. Each of the first paper tray 101 and the second paper tray 102 accommodates a sheaf of sheets P serving as a plurality of recording media. As one of feeding rollers 101*a* and 102*a* is driven and rotated selectively, the one of the feeding rollers 101*a* and 102*a* feeds an uppermost sheet P of the sheaf of sheets P toward the feeding path 30.

The bypass tray 33 is attached to a side face of a body of the image forming apparatus 1000 such that the bypass tray 33 is opened and closed relative to the body. A user opens the bypass tray 33 relative to the body of the image forming apparatus 1000 and places a sheaf of sheets P on a top face of the bypass tray 33. A feeding roller attached to the bypass tray 33 feeds an uppermost sheet P of the sheaf of sheets P placed on the bypass tray 33 toward the feeding path 30.

A detailed description is now given of a construction of the two optical writing units 1YM and 1CK.

Each of the two optical writing units 1YM and 1CK includes a laser diode, a polygon mirror, and various lenses. The optical writing units 1YM and 1CK drive the laser diodes according to image data created by a scanner separately provided from the image forming apparatus 1000 as the scanner reads an image or image data sent from a client computer. The laser diodes emit laser beams that optically scan the photoconductors 3Y, 3M, 3C, and 3K of the image forming units 2Y, 2M, 2C, and 2K, respectively. For example, a driver drives and rotates the photoconductors 3Y, 3M, 3C and 3K of the image forming units 2Y, 2M, 2C, and 2K, respectively, counterclockwise in FIG. 1 in a rotation direction D3. The optical writing unit 1YM emits a laser beam onto each of the photoconductors 3Y and 3M rotating in the rotation direction D3 while deflecting the laser beam in an axial direction of each of the photoconductors 3Y and 3M, thus performing an optical scanning process. Thus, an electrostatic latent image is formed on each of the photoconductors 3Y and 3M according to yellow and magenta image data, respectively. Similarly, the optical writing unit 1CK emits a laser beam onto each of the photoconductors 3C and 3K rotating in the rotation direction D3 while deflecting the laser beam in an axial direction of each of the photoconductors 3C and 3K, thus performing an optical scanning process. Thus, an electrostatic latent image is formed on each of the photoconductors 3C and 3K according to cyan and black image data, respectively.

A detailed description is now given of a construction of the image forming units 2Y, 2M, 2C, and 2K.

The image forming units 2Y, 2M, 2C, and 2K include the photoconductors 3Y, 3M, 3C and 3K, serving as latent image bearers, and various devices surrounding the photoconductors 3Y, 3M, 3C and 3K, which are formed into four units, respectively. Each of the four units is supported by a common support and detachable attached to the body of the image forming apparatus 1000. The four image forming units 2Y, 2M, 2C, and 2K have a substantially identical construction except for the color (e.g., yellow, magenta, cyan, and black) of toner used in the image forming units is 2Y, 2M, 2C, and 2K. Taking the image forming unit 2Y that forms a yellow toner image, for example, the image forming unit 2Y includes a developing device 4Y in addition to the photoconductor 3Y. The developing device 4Y supplies yellow toner to the electrostatic latent image formed on an outer circumferential surface of the photoconductor 3Y, thus developing the electrostatic latent image into the yellow toner image. The image forming unit 2Y further includes a charger 5Y and a drum cleaner 6Y. The charger 5Y uniformly charges the outer circumferential surface of the photoconductor 3Y while the photoconductor 3Y is driven and rotated. After the yellow toner image formed on the photoconductor 3Y passes through a primary transfer nip described below, the drum cleaner 6Y removes residual toner failed to be transferred onto the intermediate transfer belt 61 and therefore remaining on the outer circumferential surface of the photoconductor 3Y therefrom.

The photoconductor 3Y is a drum constructed of an element tube made of aluminum or the like and a photosensitive layer coating the element tube and being made of an organic sensitive material having photosensitivity. Alternatively, the photoconductor 3Y may be an endless belt instead of the drum.

The developing device 4Y includes a developing sleeve and a magnet roller. The developing sleeve is rotatable and made of a non-magnetic pipe. The magnet roller is disposed in a hollow of the developing sleeve such that the magnet roller does not rotate in accordance with rotation of the developing sleeve. The magnet roller generates a magnetic force that develops the electrostatic latent image formed on the photoconductor 3Y with a two-component developer (hereinafter referred to as a developer), containing magnetic carrier particles and non-magnetic yellow toner particles, which is supplied onto an outer circumferential surface of the developing sleeve. A potential difference between a potential of a developing bias applied to the developing sleeve and a potential of the electrostatic latent image formed on the photoconductor 3Y applies a developing potential to the yellow toner particles on the developing sleeve, which are disposed opposite the electrostatic latent image formed on the photoconductor 3Y. Conversely, a potential difference between the potential of the developing bias and a potential of a background portion on the photoconductor 3Y applies a background potential to the yellow toner particles on the developing sleeve, which are disposed opposite the background portion on the photoconductor 3Y. The developing potential and the background potential selectively adhere the yellow toner particles on the developing sleeve to the electrostatic latent image on the photoconductor 3Y, not to the background portion, thus developing the electrostatic latent image into the yellow toner image.

A yellow toner supply device supplies yellow toner, that is, yellow toner particles, contained in a yellow toner bottle 103Y to the developing device 4Y in a proper amount. A toner density sensor serving as a toner density detector is disposed in the developing device 4Y. The toner density sensor detects a magnetic permeability of the developer that is caused by carrier particles as a magnetic material. A main controller described below controls driving of the yellow toner supply device based on a comparison between an output value output by the toner density sensor and a target output value, that is, a target toner density value, output by the toner density sensor, thus adjusting a density of toner contained in the developer within a predetermined range (e.g., a range of from 4 weight percent to 9 weight percent). Similarly, the main controller controls driving of a magenta toner supply device, a cyan toner supply device, and a black toner supply device that supply magenta toner, cyan toner, and black toner supplied from a magenta toner bottle 103M, a cyan toner bottle 103C, and a black toner bottle 103K to developing devices of the image forming units 2M, 2C, and 2K, respectively.

The drum cleaner 6Y includes a cleaning blade made of polyurethane rubber. The cleaning blade contacts the photoconductor 3Y to scrape residual toner failed to be transferred onto the intermediate transfer belt 61 and therefore remaining on the photoconductor 3Y from the outer circumferential surface of the photoconductor 3Y. Alternatively, the drum cleaner 6Y may employ other cleaning method. In order to enhance cleaning performance, the drum cleaner 6Y includes a rotatable fur brush that contacts the photoconductor 3Y in addition to the cleaning blade. The fur brush also scrapes a fine, powdery lubricant off a solid lubricant and applies the fine, powdery lubricant to the outer circumferential surface of the photoconductor 3Y.

Above the photoconductor 3Y is a discharge lamp. The discharge lamp is a part of the image forming unit 2Y. The discharge lamp is disposed downstream from the drum cleaner 6Y in the rotation direction D3 of the photoconductor 3Y and discharges the outer circumferential surface of the photoconductor 3Y by optical illumination. The charger 5Y uniformly charges the discharged outer circumferential surface of the photoconductor 3Y. Thereafter, the optical writing unit 1YM performs optical scanning as described above. The charger 5Y is driven and rotated while the charger 5Y receives a charging bias from a power supply.

Alternatively, the charger 5Y may employ a scorotron charger that charges the photoconductor 3Y without contacting the photoconductor 3Y.

The above describes the construction of the image forming unit 2Y that forms the yellow toner image. Each of the image forming units 2M, 2C, and 2K that form the magenta, cyan, and black toner images, respectively, has a construction similar to the construction of the image forming unit 2Y.

A detailed description is now given of a construction of the primary transfer unit 60.

Below the four image forming units 2Y, 2M, 2C, and 2K is the primary transfer unit 60. The primary transfer unit 60 includes the intermediate transfer belt 61 serving as an image bearer stretched taut across a plurality of rollers (e.g., rollers 63, 67, 69, and 71). While the intermediate transfer belt 61 contacts the photoconductors 3Y, 3M, 3C, and 3K, one of the plurality of rollers is driven and rotated to rotate the intermediate transfer belt 61 clockwise in FIG. 1 in the rotation direction D61. Accordingly, four primary transfer nips are formed between the four photoconductors 3Y, 3M, 3C, and 3K and the intermediate transfer belt 61, respectively. At the primary transfer nips, the yellow, magenta, cyan, and black toner images formed on the photoconductors 3Y, 3M, 3C, and 3K, respectively, are primarily transferred onto the intermediate transfer belt 61.

In proximity to the four primary transfer nips are primary transfer rollers 62Y, 62M, 62C, and 62K disposed inside a loop formed by the intermediate transfer belt 61. The primary transfer rollers 62Y, 62M, 62C, and 62K press the intermediate transfer belt 61 against the photoconductors 3Y, 3M, 3C, and 3K, respectively. A primary transfer power supply applies a primary transfer bias to each of the primary transfer rollers 62Y, 62M, 62C, and 62K. Accordingly, a primary transfer electric field that electrostatically transfers the yellow, magenta, cyan, and black toner images formed on the photoconductors 3Y, 3M, 3C, and 3K, respectively, onto the intermediate transfer belt 61 is produced at each of the four primary transfer nips.

As the intermediate transfer belt 61 rotates clockwise in FIG. 1 in the rotation direction D61 and passes through the four primary transfer nips successively, the yellow, magenta, cyan, and black toner images formed on the four photoconductors 3Y, 3M, 3C, and 3K, respectively, are primarily transferred onto an outer circumferential surface of the intermediate transfer belt 61 at the four primary transfer nips successively such that the yellow, magenta, cyan, and black toner images are superimposed on a same position on the intermediate transfer belt 61. Accordingly, the outer circumferential surface of the intermediate transfer belt 61 bears the yellow, magenta, cyan, and black toner images superimposed thereon.

A detailed description is now given of a construction of the secondary transfer unit 78.

Below the intermediate transfer belt 61 is the secondary transfer unit 78. The secondary transfer unit 78 includes an endless, secondary transfer belt 77, a grounded driven roller 72, a driving roller, a secondary transfer belt cleaner 76, and a toner adhesion amount sensor 64. The secondary transfer belt 77 is stretched taut across the grounded driven roller 72 and the driving roller that are disposed inside a loop formed by the secondary transfer belt 77. As the driving roller is driven and rotated, the driving roller rotates the secondary transfer belt 77 counterclockwise in FIG. 1.

The secondary transfer belt 77 of the secondary transfer unit 78 at a looped position where the secondary transfer belt 77 is looped over the grounded driven roller 72 contacts the intermediate transfer belt 61 of the primary transfer unit 60 at a looped position where the intermediate transfer belt 61 is looped over a secondary transfer bias roller 68, thus forming a secondary transfer nip between the intermediate transfer belt 61 and the secondary transfer belt 77. The secondary transfer bias roller 68 disposed inside the loop formed by the intermediate transfer belt 61 is applied with a secondary transfer bias output by a secondary transfer power supply described below. Conversely, the grounded driven roller 72 disposed inside the loop formed by the secondary transfer belt 77 is grounded. Accordingly, a secondary transfer electric field is created at the secondary transfer nip.

On the right of the secondary transfer nip in FIG. 1 is the registration roller pair 34 that feeds the sheet P sandwiched between two rollers of the registration roller pair 34 to the secondary transfer nip at a time when the yellow, magenta, cyan, and black toner images superimposed on the intermediate transfer belt 61 reach the secondary transfer nip. At the secondary transfer nip, the yellow, magenta, cyan, and black toner images superimposed on the intermediate transfer belt 61 are secondarily transferred onto the sheet P collectively under the secondary transfer electric field and pressure. Thus, the transferred, yellow, magenta, cyan, and black toner images form a full color toner image with a white background on the sheet P.

After passing through the secondary transfer nip, the outer circumferential surface of the intermediate transfer belt 61 is adhered with residual toner failed to be secondarily transferred onto the sheet P. An intermediate transfer belt cleaner 75 of the primary transfer unit 60 removes the residual toner from the outer circumferential surface of the intermediate transfer belt 61.

A detailed description is now given of a construction of the conveyance belt unit 35.

After passing through the secondary transfer nip, the sheet P is separated from the intermediate transfer belt and the secondary transfer belt 77 and is delivered to the conveyance belt unit 35. The conveyance belt unit 35 includes a driving roller 37, a driven roller and an endless, conveyance belt 36 stretched taut across the driving roller 37 and the driven roller 38. As the driving roller 37 is driven and rotated, the driving roller 37 rotates the conveyance belt 36 counterclockwise in FIG. 1. While an upper stretched face of the conveyance belt 36 carries the sheet P delivered from the secondary transfer nip, the conveyance belt 36 delivers the sheet P to the fixing device 40 as the conveyance belt 36 rotates counterclockwise in FIG. 1.

A detailed description is now given of a construction of the fixing device 40.

The sheet P sent to the fixing device 40 is sandwiched between an endless, fixing belt and a pressure roller at a fixing nip formed between the fixing belt and the pressure roller. The fixing belt and the pressure roller fix the full color toner image on a surface of the sheet P under heat and pressure.

A detailed description is now given of a construction of the conveyance switch device 50.

The sheet P secondarily transferred with the full color toner image on a first side of the sheet P at the secondary transfer nip and fixed with the full color toner image on the first side of the sheet P by the fixing device 40 is sent to the conveyance switch device 50. The image forming apparatus 1000 includes the conveyance switch device 50, a refeeding path 54, a switch-back path 55, and a post switch-back conveyance path 56, which construct a refeeder. The conveyance switch device 50 switches destination of the sheet P received from the fixing device 40 between the output path 51 and the refeeding path 54.

For example, if the image firming apparatus 1000 receives a one-sided print job to form a toner image on the first side of the sheet P, the conveyance switch device 50 directs the sheet P to the output path 51. The conveyance switch device 50 sends the sheet P bearing the toner image on the first side of the sheet P to the output roller pair 52 through the output path 51. The output roller pair 52 ejects the sheet P onto the output tray 53 disposed outside the body of the image forming apparatus 1000. If the image forming apparatus 1000 receives a two-sided print job to form a toner image on both sides, that is, the first side and a second side, of the sheet P, the conveyance switch device 50 directs the sheet P bearing the toner image on both sides of the sheet P to the output path 51 as the conveyance switch device 50 receives the sheet P from the fixing device 40. The conveyance switch device 50 sends the sheet P bearing the toner image on both sides of the sheet P to the output tray 53 disposed outside the body of the image forming apparatus 1000.

Conversely, if the image forming apparatus 1000 receives a two-sided print job to form a toner image on both sides of the sheet P, the conveyance switch device 50 directs the sheet P bearing the toner image on the first side of the sheet P to the refeeding path 54 as the conveyance switch device 50 receives the sheet P bearing the toner image on the first side of the sheet P from the fixing device 40. Since the refeeding path 54 is coupled to the switch-back path 55, the sheet P sent to the refeeding path 54 enters the swatch-back path 55. When the sheet P enters the switch-back path 55 entirely in a sheet conveyance direction, the switch-back path 55 reverses the sheet conveyance direction of the sheet P to switch back the sheet P. Since the post switch-back conveyance path 56, in addition to the refeeding path 54, is coupled to the switch-back path 55, the sheet P that is switched back enters the post switch-back conveyance path 56. Accordingly, the sheet P is reversed. The reversed sheet P is resent to the secondary transfer nip through the post switch-back conveyance path 56 and the feeding path 30. The sheet P secondarily transferred with another toner image on the second side of the sheet P at the secondary transfer nip is sent to the fixing device 40 where the another toner image is fixed on the second side of the sheet P. Thereafter, the sheet P bearing the fixed toner image is ejected onto the output tray 53 through the conveyance switch device 50, the output path 51, and the output roller pair 52.

A description is provided of a construction of the fixing device 40 incorporated in the image forming apparatus 1000 having the construction described above.

Figure 2:
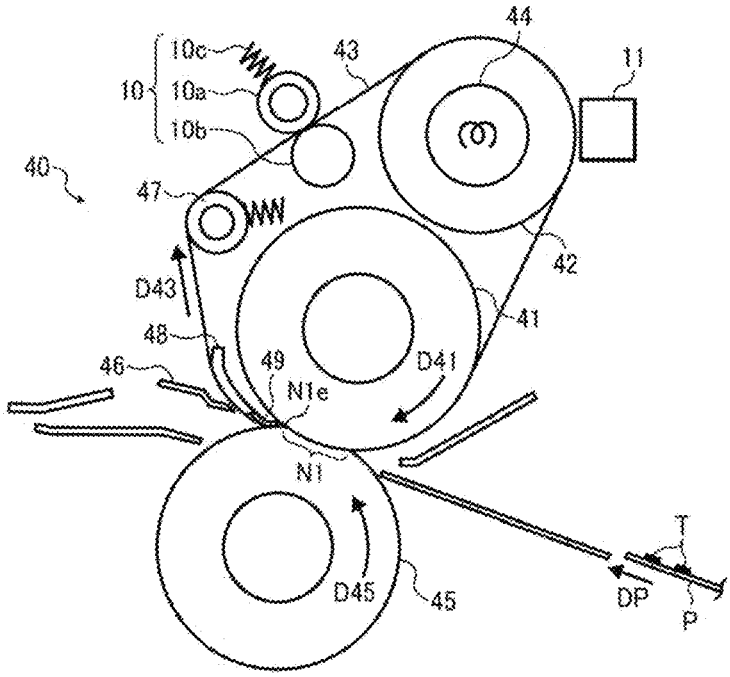
FIG. 2 is a vertical cross-sectional view of a fixing device incorporated in the image forming apparatus depicted in FIG. 1.

FIG. 2 is a schematic vertical cross-sectional view of the fixing device 40. As illustrated in FIG. 2, the fixing device 40 (e.g., a fuser or a fusing unit) employs a belt fixing system and includes a fixing belt 43 rotatable in a rotation direction D43 and a pressure roller 45 serving as a pressure rotator disposed opposite the fixing belt 43 and rotatable in a rotation direction D45. The fixing belt 43 is stretched taut across a fixing roller 41, a heating roller 42, a tension roller 47, and the like. A shaft of each of the fixing roller 41, the heating roller 42, and the pressure roller 45 is rotatably mounted on a frame of the fixing device 40 and extends in a longitudinal direction of the frame of the fixing device 40.

A detailed description is now given of a construction of the fixing belt 43.

The fixing belt 43 is an endless belt constructed of a polyimide (PI) layer and an outer circumferential surface layer coating the PI layer and being made of an offset inhibitor such as tetrafluoroethylene-perfluoroalkylvinylether copolymer (PFA) film. Each of the fixing roller 41 and the pressure roller 45 is a rubber roller. As the pressure roller 45 is pressed against the fixing roller 41 radially via the fixing belt 43, a fixing nip N1 is formed between the pressure roller 45 and the fixing belt 43. The tension roller 47 places tension to the fixing belt 43. The tension roller 47 includes an aluminum tube that is tubular or cylindrical.

A detailed description is now given of a construction of the pressure roller 45.

The pressure roller 45 separably contacts the fixing belt 43. While a sheet P is conveyed through the fixing device 40 for a fixing job, a pressurization assembly presses the pressure roller 45 against the fixing belt 43 to form the fixing nip N1 therebetween. Conversely, while the fixing device 40 is in a standby mode to wait for the fixing job, the pressurization assembly releases pressure exerted to the pressure roller 45 to separate the pressure roller 45 from the fixing belt 43.

A detailed description is now given of a construction of the heating roller 42.

The heating roller 42 is a hollow roller being made of aluminum or iron and accommodating a heater 44 (e.g., a halogen heater) serving as a heater or a heat source. Alternatively, the heater 44 may be an induction heater (IH). A thermistor 11 (e.g., a temperature sensor element) is disposed opposite the heating roller 42 via the fixing belt 43. The heater 44 is controlled based on a temperature of the fixing belt 43 that is detected by the thermistor 11 so that the heater 44 heats the fixing belt 43 to a target temperature.

A detailed description is now given of a configuration of the fixing roller 41.

A driver (e.g., a motor and a reduction gear train) is coupled to the fixing roller 41 to drive and rotate the fixing roller 41 clockwise in FIG. 2 in a rotation direction D41. As the fixing roller 41 rotates in the rotation direction D41, the fixing roller 41 frictionally rotates the fixing belt 43 clockwise in FIG. 2 in the rotation direction D43 and the pressure roller 45 pressed against the fixing roller 41 via the fixing belt 43 counterclockwise in FIG. 2 in the rotation direction D45 at an identical rotation speed. Alternatively, the driver may be coupled to the pressure roller 45 to drive and rotate the pressure roller 45 which rotates the fixing belt 43 pressed by the pressure roller 45 and the fixing roller 41 in accordance with rotation of the pressure roller 45.

A description is provided of a construction of a polisher 10 incorporated in the fixing device 40.

The polisher 10 is interposed between the tension roller 47 and the heating roller 42 in the rotation direction D43 of the fixing belt 43. The polisher 10 polishes an outer circumferential surface of she fixing belt 43. The polisher 10 includes a polishing roller 10*a*, an opposed roller 10*b*, and a spring 10*c*. The polishing roller 10*a* contacts the outer circumferential surface of the fixing belt 43. The opposed roller 10*b* is disposed opposite the polishing roller 10*a* via the fixing belt 43. The spring 10*c* presses the polishing roller 10*a* against the fixing belt 43. Each of the polishing roller 10*a* and the opposed roller 10*b* comes into contact with and separates from the fixing belt 43. While the polishing roller 10*a* is not requested to polish the fixing belt 43, the polishing roller 10*a* and the opposed roller 10*b* are separated from the fixing belt 43 to extend the life of the fixing belt 43.

While the sheet P is conveyed through the fixing nip N1, burrs produced on the sheet P by cutting may scratch and damage the outer circumferential surface of the fixing belt 43, resulting in abrasion of the fixing belt 43. Accordingly, abrasion of an inboard span of the fixing belt 43 that corresponds to a width of a frequently used size sheet P in an axial direction of the fixing belt 43 is different from abrasion of an outboard span of the fixing belt 43 that is outboard from the inboard span in the axial direction of the fixing belt 43. Consequently, while a large sheet P having a width greater than the width of the frequently used size sheet P in the axial direction of the fixing belt 43 is conveyed over the fixing belt 43, since the large sheet P is conveyed over the outboard span of the fixing belt 43, abrasion of the outboard span of the fixing belt 43 may damage a toner image T on the large sheet P. To address this circumstance, according to this exemplary embodiment, the polishing roller 10*a* of the polisher 10 polishes the outer circumferential surface of the fixing belt 43, evening abrasion of the fixing belt 43 in the axial direction thereof and thereby preventing the fixing belt 43 from damaging the toner image T on the sheet P.

A description is provided of a configuration of a separation aid 48 incorporated in the fixing device 40.

The separation aid 48 serving as a primary separator is disposed inside a loop formed by the fixing belt 43 and disposed downstream from the fixing nip N1 in the rotation direction D43 of the fixing belt 43. For example, the separation aid 48 is made of metal such as SUS stainless steel and a rigid body such as resin. The separation aid 48 is a curved block or a substantially arcuate block in cross-section. The separation aid 48 contacts an inner circumferential surface of the fixing belt 43 at a downstream position disposed downstream from the fixing nip N1 in the rotation direction D43 of the fixing belt 43. The fixing belt 43 is looped over the separation aid 48 such that the separation aid 48 stretches the fixing belt 43 in a separation direction in which the fixing belt 43 separates from the fixing roller 41 to change the rotation direction D43 of the fixing belt 43 sharply. For example, the separation aid 48 changes the rotation direction D43 of the fixing belt 43 sharply to increase a curvature of the fixing belt 43 and decrease a radius of curvature of the fixing belt 43. The increased curvature of the fixing belt 43 facilitates separation of the sheet P, improving separation performance of the fixing device 40.

The separation aid 48 includes an arcuate contact face that contacts the fixing belt 43. The fixing belt 43 slides over the arcuate contact face of the separation aid 48 smoothly.

The separation aid 48 further includes an arcuate opposed face that is disposed opposite the fixing roller 41 and curved along an outer circumferential surface of the fixing roller 41. Accordingly, the separation aid 48 is disposed inside a limited space inside the loop formed by the fixing belt 43 without contacting the fixing roller 41.

The separation aid 48 extends in an axial direction of the fixing roller 41 throughout the entire span of the fixing roller 41 in the axial direction thereof. Both lateral ends of the separation aid 48 in the axial direction of the fixing roller 41 are mounted on or secured to side faces of the frame of the fixing device 40, respectively. The separation aid 48 does not press against the pressure roller 15, enhancing durability of the pressure roller 45 and preventing a torque of the motor from increasing.

A description is provided of a configuration of a separation plate 46 and a presser 49 incorporated in the fixing device 40.

The separation plate 46 serving as a secondary separator is disposed opposite the separation aid 48 via the fixing belt 43. A front end of the separation plate 46 is disposed opposite the fixing belt 43 with a slight interval therebetween. The front end of the separation plate 46 is tapered off and has a sharp edge. The presser 49 is interposed between the fixing nip N1 and the separation aid 48 in the rotation direction D43 of the fixing belt 43 and in contact with the inner circumferential surface of the fixing belt 43. The presser 49 presses the fixing belt 43 against the pressure roller 45.

A description is provided of a fixing operation of the fixing device 40 to fix a toner image T on a sheet P.

As the sheet P bearing the toner image T is conveyed through the fixing nip N1, toner of the toner image T is melted and fixed on the sheet P under heat and pressure. The separation plate 46 or the like disposed downstream from an exit N1*e* of the fixing nip N1 in a sheet conveyance direction DP separates or peels the sheet P from the fixing belt 43. Thereafter, the sheet P is ejected from the fixing device 40. An ejection sensor is disposed in proximity to an exit of the fixing device 40 to detect that the sheet P has passed through the fixing slip N1 at a predetermined time. If the ejection sensor does not detect that the sheet P has passed through the fixing nip N1 at the predetermined time, the main controller determines that the sheet P is jammed at the fixing nip N1 and activates a jam handling mode in which the main controller notifies the user to remote the jammed sheet P from the fixing device 40.

A description is provided of a construction of a comparative fixing device 40C.

Figure 3:
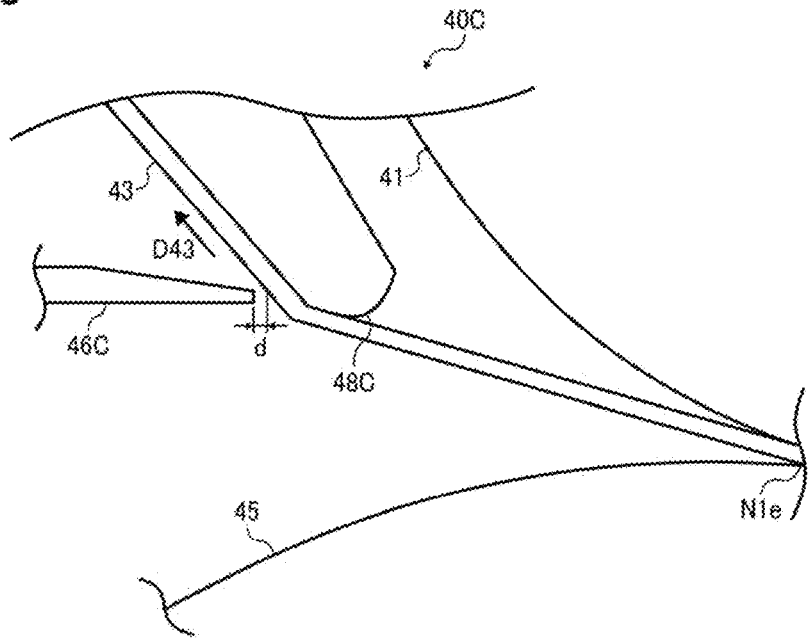
FIG. 3 is a partially enlarged, vertical cross-sectional view of a comparative fixing device.

FIG. 3 is a partially enlarged, vertical cross-sectional view of the comparative fixing device 40C, illustrating a periphery of the exit N1*e* of the fixing nip N1.

The comparative fixing device 40C includes a separation plate 46C that separates a sheet P from the fixing belt 43. For example, when a leading edge of a soft, thin sheet P such as thin paper that is not separated from the fixing belt 43 easily with the curvature of the fixing belt 43 comes into contact with a front edge of the separation plate 46C, the separation plate 46C separates the thin sheet P from the fixing belt 43. If the front edge of the separation plate 46C contacts the fixing belt 43, the separation plate 46C may shave or scratch the fixing belt 43, shortening the life of the fixing belt 43. In order to prohibit the front edge of the separation plate 46C from contacting the fixing belt 43 and allow the thin sheet P to come into contact with the separation plate 46C precisely, an interval d of about 0.2 mm between the fixing belt 43 and the separation plate 46C is requested to be retained precisely.

To address this request, a separation aid 48C disposed opposite the separation plate 46C via the fixing belt 43 is made of a rigid body to suppress change in the interval d between the fixing belt 43 and the separation plate 46C due to deformation of the separation aid 48C. If the separation aid 48C made of the rigid body presses against the pressure roller 45 via the fixing belt 43, the separation aid 48C may be deformed resiliency by pressure from the pressure roller 45, resulting in change in the interval d between the fixing belt 43 and the separation plate 46C. Further, the durability of the pressure roller 45 may decrease. As illustrated in Table 1 below, that indicates a result of a durability test of the pressure roller 45 and the fixing belt 43, if the separation aid 48C is retracted from the pressure roller 45 by a length of 2 mm, the separation aid 48C substantially doubles the life of the pressure roller 45 and the fixing belt 43.

TABLE 1

| Separation aid | Pressure roller | Fixing belt |
|---|---|---|
| Pressing against pressure roller with engagement of 0.5 mm | 600 kp | 600 kp |

TABLE 1-continued

| Separation aid | Pressure roller | Fixing belt |
|---|---|---|
| Pressing against pressure roller with engagement of 0 mm | 750 kp | 750 kp |
| Retracting from pressure roller by length of 2 mm | 1,400 kp | 1,400 kp |

However, since the separation aid 48C is spaced apart from the pressure roller 45, the sheet P adhered to the fixing belt 43 is not exerted with pressure from the pressure roller 45 in a separation span of the fixing belt 43 that is defined from a nip position disposed opposite the fixing nip N1 to a separation position disposed opposite the front edge of the separation plate 46C. As the sheet P is heated by the fixing belt 43 at the fixing nip N1, moisture contained in the sheet P is vaporized into steam. While the sheet P is conveyed through the fixing nip N1, since the sheet P receives substantial surface pressure of about 40 [N/cm$^2$], steam is not discharged from the sheet P. Conversely, when the sheet P is ejected from the fixing nip N1, since the sheet P receives no pressure, steam is discharged from the sheet P.

As illustrated in FIG. 3, a decreased gap between the pressure roller 45 and the fixing belt 43 stretched by the separation aid 48C at a position in proximity to the exit N1*e* of the fixing nip N1 is smaller than an increased gap between the pressure roller 45 and the fixing belt 43 configured to be wound around the fixing roller 41. Since heat is stored in the decreased gap between the pressure roller 15 and the fixing belt 43 stretched by the separation aid 48C, the temperature of the sheet P does not decrease and substantial steam is discharged from the sheet P. Steam is mainly discharged from a back side of the sheet P that is disposed opposite the pressure roller 45. The sheet P ejected from the fixing nip N1, while the sheet P is adhered to the fixing belt 43, is convened to the separation position of the fixing belt 43 that is disposed opposite the front edge of the separation plate 40C. A height of a non-image section on the sheet P that does not bear the toner image T is smaller than a height of an image section on the sheet P that hears the toner image T. Accordingly, a gap is produced between the fixing belt 43 and the non-image section on the sheet P. Steam is discharged from the sheet P to the gap. As the sheet P discharges steam, fiber of the sheet P dries. Accordingly, the sheet P shrinks and waves.

Steam mainly discharged from the back side of the sheet P that is disposed opposite the pressure roller 45 remains in the decreased gap between the pressure roller 45 and the fixing belt 43 stretched by the separation aid 48C. Steam is reabsorbed by the sheet P and moistens the sheet P. Steam discharged to the gap between the fixing belt 43 and the non-image section on the sheet P remains in the decreased gap. Steam is reabsorbed by the sheet P and moistens the sheet P. As the sheet P is moistened, fiber of the sheet P stretches. Accordingly, the sheet P waves.

Figure 4:
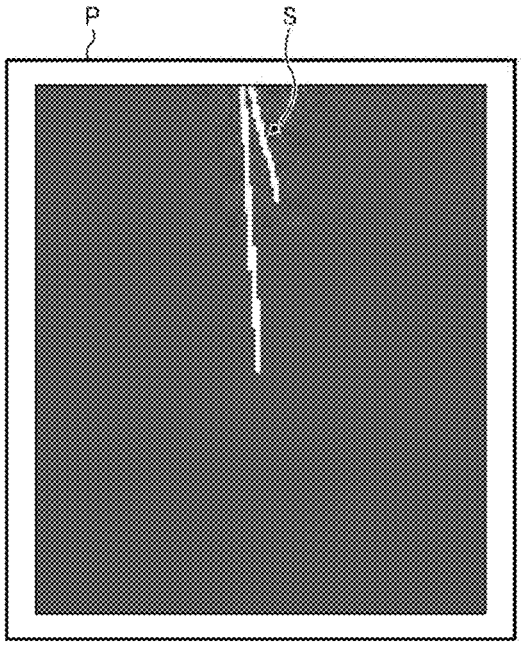
FIG. 4 is a plan view of a sheet having creases produced after the sheet passes through the comparative fixing device depicted in FIG. 3.

In the comparative fixing device 40C depicted in FIG. 3, while the sheet P is conveyed in the separation span of the fixing belt 43 that is defined from the nip position disposed opposite the fixing nip N1 to the separation position disposed opposite the front edge of the separation plate 46C, fiber of the sheet P suffers from contraction as the sheet P discharges steam and dries and expansion as the sheet P reabsorbs steam and moistens. Accordingly, the sheet P waves. As the waved sheet P is sandwiched by the output roller pair 52 or the like depicted in FIG. 1, the sheet P may suffer from creases S as illustrated in FIG. 4. FIG. 4 is a plan view of the sheet P having the creases S.

To address this circumstance, the fixing device 40 according to this exemplary embodiment depicted in FIG. 2 incorporates the presser 49 that is interposed between the fixing roller 41 and the separation aid 48 in the rotation direction D43 of the fixing belt 43 and in contact with the inner circumferential surface of the fixing belt 43. The presser 49 presses the fixing belt 43 against the pressure roller 45.

A detailed description is now given of a construction of the presser 49.

Figure 5:
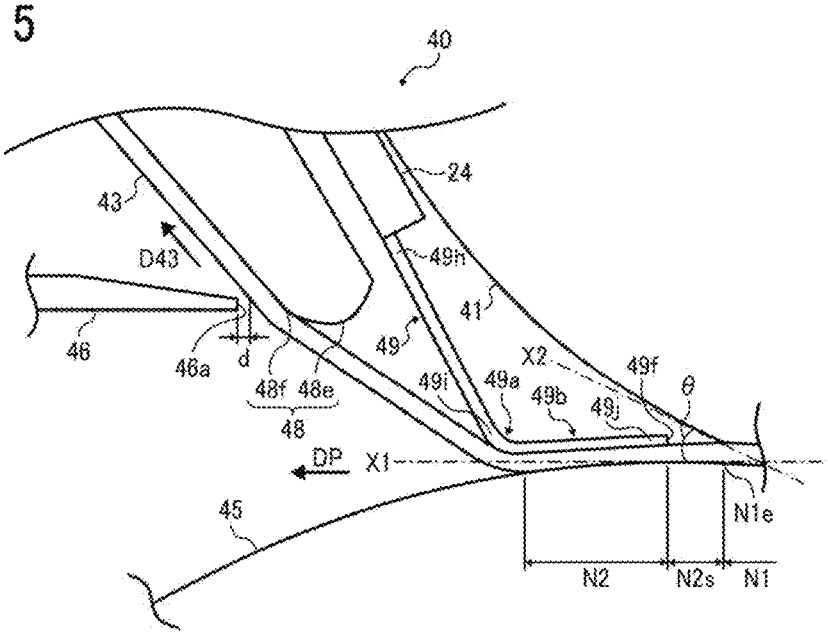
FIG. 5 is a partially enlarged, vertical cross-sectional view of the fixing device depicted in FIG. 2, illustrating a presser incorporated therein.

FIG. 5 is a partially enlarged, vertical cross-sectional view of the fixing device 40, illustrating components situated in proximity to the exit N1*e* of the fixing nip N1. The presser 49 is disposed inside the loop formed by the fixing belt 43 and interposed between the fixing roller 41 and the separation aid 48 in the rotation direction D43 of the fixing belt 43. The presser 49 is a plate made of metal such as SUS stainless steel and has a thickness of about 0.2 mm. One end of the presser 49 is supported by a support plate 24. The presser 49 extends from the support plate 24 toward the pressure roller 45. The presser 49 is bent toward the fixing nip N1 at an intermediate portion 49*i* of the presser 49, thus defining a flat spring shape. Since the presser 49 is bent at the intermediate portion 49*i* thereof, the presser 49 contacts the inner circumferential surface of the fixing belt 43. Hence, the presser 49 includes a pressing portion 49*b* and a peel-off portion 49*a*. The pressing portion 49*b* presses the fixing belt 43 against the pressure roller 45. The peel-off portion 49*a* is curved and disposed downstream from the pressing portion 49*b* in the rotation direction D43 of the fixing belt 43.

The presser 49 engages the pressure roller 45 by 0.4 mm. The presser 49 is resiliency deformed to press the fixing belt 43 against the pressure roller 45 with a predetermined load. Accordingly, the presser 49 forms a post nip N2 that is disposed downstream from the fixing nip N1 in the sheet, conveyance direction DP.

The pressing portion 49*b* of the presser 49 has a shape corresponding to an outer circumferential surface of the pressure roller 45 to press the fixing belt 43 against the pressure roller 45 evenly. At an exit of the post nip N2, the rotation direction D43 of the fixing belt 43 changes sharply along a curve of the peel-off portion 49*a* of the presser 49. Accordingly, the curvature of the fixing belt 43 increases at the exit of the post nip N2. In other words, the radius of curvature of the fixing belt 43 decreases at the exit of the post nip N2. According to this exemplary embodiment, the peel-off portion 49*a* of the presser 49 is curved such that the radius of curvature of the fixing belt 43 is 6 mm at the exit of the post nip N2.

The sheet R ejected from the fixing nip N1 is conveyed while the sheet P receives pressure from the pressure roller 45 at the post nip N2 continuously after the sheet P receives pressure at the fixing nip N1. Since pressure exerted to the sheet P at the post nip N2 is smaller than pressure exerted to the sheet P at the fixing nip N1, the sheet P discharges steam at the post nip N2. As the sheet P discharges steam, the sheet P is susceptible to drying of fiber and shrink. However, since the presser 49 presses the sheet P against the pressure roller 45 via the fixing belt 43, fiber of the sheet P does not shrink and therefore the sheet P is immune from waving caused by discharging of steam.

Steam discharged at the post nip N2 remains between the sheet P and the fixing belt 43 and the like as air bubbles and is reabsorbed by the sheet P, moistening the sheet P. However, while the sheet P absorbs steam, the presser 49 presses the sheet P against the pressure roller 45 via the fixing belt 43. Accordingly, even if fiber of the sheet P that absorbs steam and moistens is susceptible to stretch, since the presser 49 presses the sheet P against the pressure roller 45 via the fixing belt 43, fiber of the sheet P does not stretch and therefore the sheet P is immune from waving caused by absorption of steam.

Since the sheet P is immune from waving, even when the sheet P ejected from the fixing nip N1 is sandwiched and conveyed by the output roller pair 52 depleted in FIG. 1, the sheet P is immune from the streaked creases S illustrated in FIG. 4.

According to this exemplary embodiment, the presser 49 presses the sheet P against the pressure roller 45 via the fixing belt 43 to prevent fiber of the sheet P from contracting and expanding as the sheet P discharges and absorbs steam. Pressure with which the presser 49 presses the sheet P against the pressure roller 45 via the fixing belt 43 is sufficiently smaller than pressure with which the pressure roller 45 presses the sheet P against the fixing roller 41 via the fixing belt 43 at the fixing nip N1. According to this exemplary embodiment, pressure excited to the sheet P at the post nip N2 is about 5 [N]. The presser 49 suppresses waving of the sheet P with pressure great enough to prevent the streaked creases S from being produced on the sheet P illustrated in FIG. 4. Hence, the presser 49 may press the fixing belt 43 toward the pressure roller 45 such that the fixing belt 43 is in contact with or in proximity to the pressure roller 45 with a slight interval between the fixing belt 43 and the pressure roller 45. In this case, when the sheet P is ejected from the fixing nip N1 and is susceptible to waving as the sheet P discharges and absorbs steam, the sheet P comes into contact with the pressure roller 45 or the fixing belt 43 which prevents the sheet P from waving further. Hence, even if the presser 49 presses the fixing belt 43 toward the pressure roller 45 such that the fixing belt 43 is in contact with or in proximity to the pressure roller 45 with the slight interval between the fixing belt 43 and the pressure roller 45, the presser 49 suppresses waving of the sheet P.

In a configuration in which the presser 49 presses the fixing belt 43 toward the pressure roller 45 such that the fixing belt 43 does not contact the pressure roller 45, if the slight interval between the fixing belt 43 and the pressure roller 45 is equivalent to a thickness of the sheet P, the sheet P ejected from the fixing nip N1 is conveyed while the sheet P is sandwiched between the fixing belt 43 and the pressure roller 45. Thus, the presser 49 suppresses waving of the sheet P more effectively.

At the exit of the post nip N2, the rotation direction D43 of the fixing belt 43 changes sharply along the curve of the peel-off portion 49*a* of the presser 49. Accordingly, the sheet P is separated from the fixing belt 43 by the curvature of the fixing belt 43 at the exit of the post nip N2. A soft sheet P such as thin paper or a sheet P bearing a toner image T extending to a leading end of the sheet P is not separated from the fixing belt 43 by the curvature of the fixing belt 43 at the exit of the post nip N2 and is conveyed to a separation position of the fixing belt 43 that is disposed opposite a front edge 46*a* of the separation plate 46 while the sheet P adheres to the fixing belt 43.

However, steam generated by the sheet P while the sheet P is conveyed through the fixing nip N1 already discharged from the sheet P while the sheet P is conveyed through the post nip N2. Accordingly, steam is barely discharged from the sheet P while the sheet P moves to the separation position of the fixing belt 43 that is disposed opposite the front edge 46*a* of the separation plate 46. Additionally, an increased gap between the fixing belt 43 and the pressure roller 45 at a position in proximity to the exit of the post nip N2 is greater than the decreased gap between the pressure roller 45 and the fixing belt 43 depicted in FIG. 3. Accordingly, heat is not stored at the position in proximity to the exit of the post nip N2 and is dissipated to surroundings. Hence, while the sheet P moves to the separation position of the fixing belt 43 that is disposed opposite the front edge 46*a* of the separation plate 46, the sheet P is barely heated by heat stored at the position in proximity to the exit of the post nip N2 and therefore barely discharges steam. Consequently, while the sheet P moves from the post nip N2 to the separation position of the fixing belt 43 that is disposed opposite the front edge 46*a* of the separation plate 46, the sheet P barely discharges steam and dries and therefore barely waves.

Steam not reabsorbed by the sheet P at the post nip N2 is discharged to the surroundings at the exit of the post nip N2. However, since the increased gap between the fixing belt 43 and the pressure roller 45 at the position in proximity to the exit of the post nip N2 is greater than the decreased gap between the pressure roller 45 and the fixing belt 43 depicted in FIG. 3, steam does not accumulate at the position in proximity to the exit of the post nip N2. Accordingly, while the sheet P moves from the post nip N2 to the separation position of the fixing belt 43 that is disposed opposite the from edge 46*a* of the separation plate 46, the sheet P barely reabsorbs steam. Consequently, while the sheet P moves from the post nip N2 to the separation position of the fixing belt 43 that is disposed opposite the front edge 46*a* of the separation plate 46, the sheet P barely reabsorbs steam and moistens and therefore barely waves.

Since the presser 49 presses the fixing belt 43 against the pressure roller 45, the fixing belt 43 is hung freely without contacting any component in a free span defined from the exit of the post nip N2 to the separation aid 48 in the rotation direction D43 of the fixing belt 43. The free span of the fixing belt 43 of the fixing device 40 depicted in FIG. 5 is smaller than a free span of the fixing belt 43 that is defined from the exit N1*e* of the fixing nip N1 to the separation aid 48C of the comparative fixing device 40C in the rotation direction D43 of the fixing belt 43 depicted in FIG. 3.

A thermal capacity of the presser 49 made of a plate is smaller than a thermal capacity of the presser 49 made of a block, suppressing conduction of heat from the fixing belt 43 to the presser 49 formed in the plate. Accordingly, compared to the presser 49 made of the block, the presser 49 made of the plate shortens a waiting time for the user to wait until the fixing belt 43 is heated to the target temperature. Additionally, compared to the configuration in which the presser 49 is the block, the presser 49 made of the plate suppresses power consumption, saving energy.

Since the presser 49 is made of a resilient material, the presser 49 deforms along the outer circumferential surface of the pressure roller 45 readily compared to the presser 49 made of a rigid body. Thus, the presser 49 presses the fixing belt 43 against the pressure roller 45 evenly with a predetermined load.

According to this exemplary embodiment, the sheet P separates from the fixing belt 43 at three separation positions thereon. The three separation positions include a first separation position where the fixing belt 43 is curved at the exit of the post nip N2 formed between the peel-off portion 49*a* of the presser 49 and the pressure roller 45; a second separation position where the fixing belt 43 is curved by the separation aid 48; and a third separation position where the fixing belt 43 is disposed opposite the front edge 46*a* of the separation plate 46. Accordingly, the fixing belt 43 attaining the three separation positions separates the sheet P from the fixing belt 43 precisely, preventing the sheet P from being jammed between the fixing belt 43 and the pressure roller 45 effectively.

A description is provided of a first variation of the presser 49.

Figure 6:
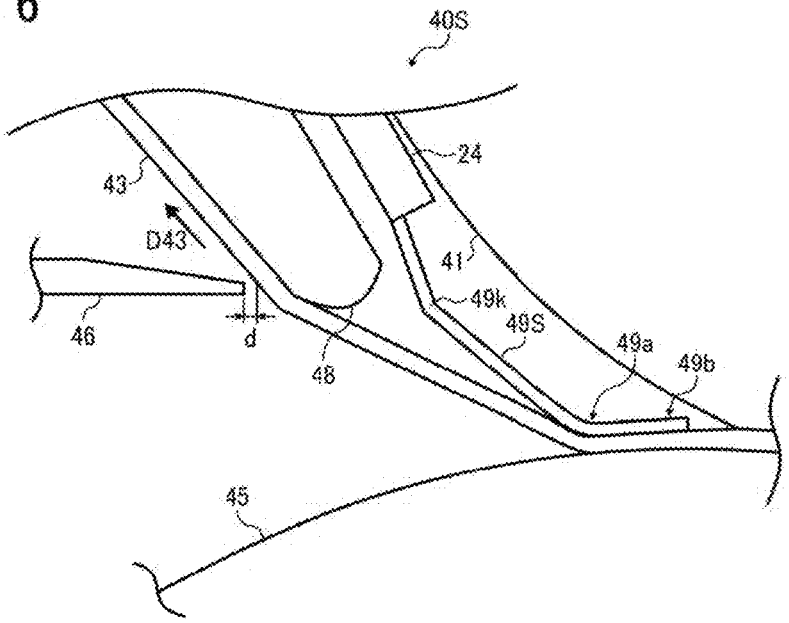
FIG. 6 is a partial vertical cross-sectional view of a fixing device incorporating a presser as a first variation of the presser depicted in FIG. 5.

FIG. 6 is a partial vertical cross-sectional view of a fixing device 40S incorporating a presser 49S as the first variation of the presser 49 depicted in FIG. 5. As illustrated in FIG. 6, the presser 49S includes a bent portion 49*k* that is also bent toward the fixing belt 43 at a position in proximity to the support plate 24. The bent portion 49*k* extends from the support plate 24 toward the pressure roller 45 and is disposed downstream from the peel-off portion 49*a* in the rotation direction D43 of the fixing belt 43. The presser 49S resiliently deforms readily to curve along the outer circumferential surface of the pressure roller 45 precisely, enhancing durability of the pressure roller 45.

A description is provided of a second variation of the presser 49.

Figure 7:
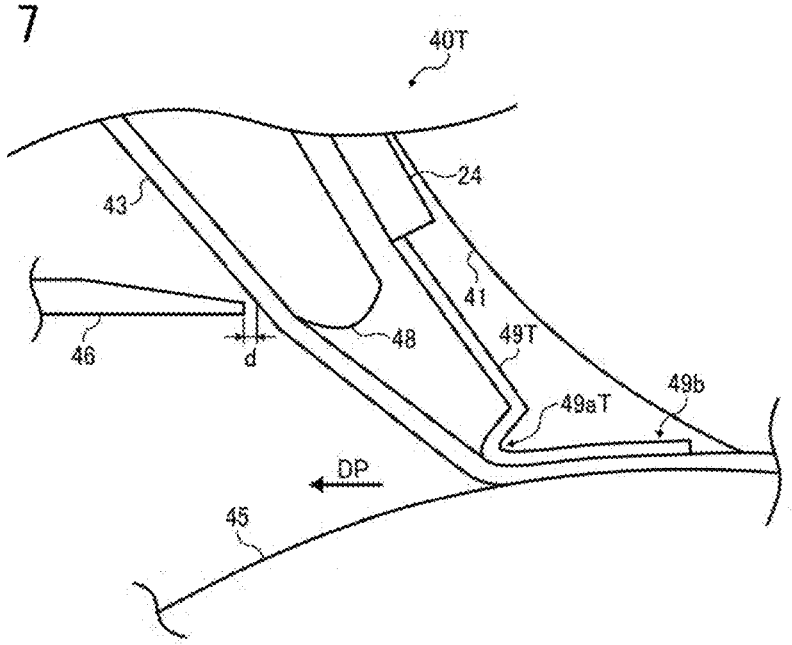
FIG. 7 is a partial vertical cross-sectional view of a fixing device incorporating a presser as a second variation of the presser depicted in FIG. 5.

FIG. 7 is a partial vertical cross-sectional view of a fixing device 40T incorporating a presser 49T as the second variation of the presser 49 depicted in FIG. 5. As illustrated in FIG. 7, the presser 49T includes a peel-off portion 49*a*T that projects from the pressing portion 49*b* in the sheet conveyance direction DP. The peel-off portion 49*a*T increases the curvature of the fixing belt 43 at the exit of the post nip N2 formed by the peel-off portion 49*a*T. In other words, the peel-off portion 49*a*T decreases the radius of curvature of the fixing belt 43 at the exit of the post nip N2, facilitating separation of the sheet P from the fixing belt 43 at the exit of the post nip N2.

A description is provided of two third variations of the presser 49.

Figure 8:
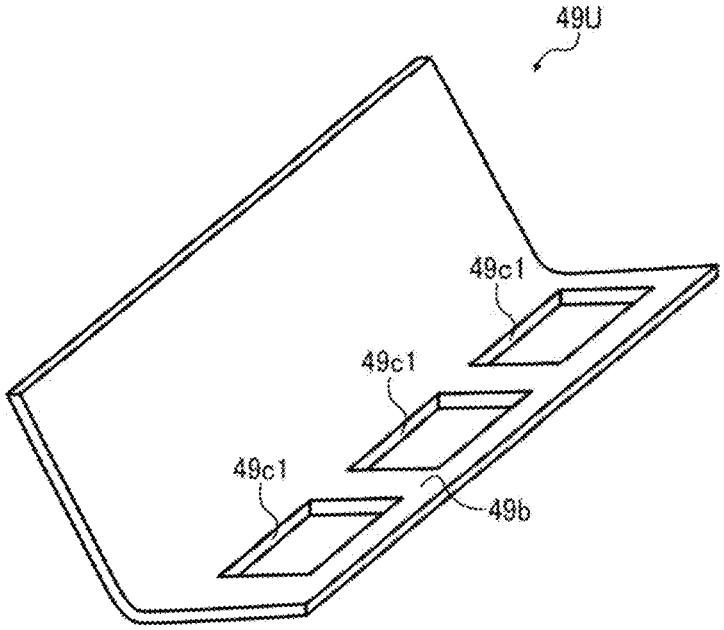
FIG. 8 is a perspective view of a presser as one of third variations of the presser depicted in FIG. 5.
Figure 9:
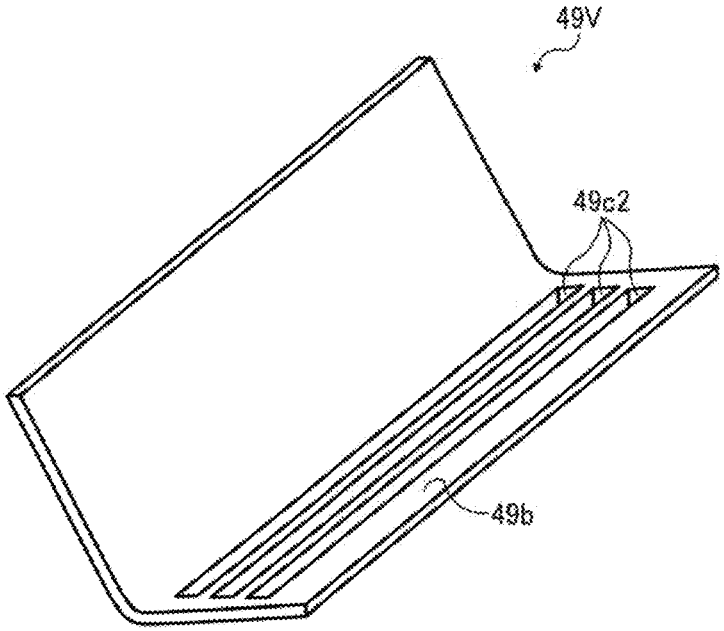
FIG. 9 is a perspective view of a presser as another one of the third variations of the presser depicted in FIG. 5.

FIG. 8 is a perspective view of a presser 49U as one of the third variations of the presser 49 depicted in FIG. 5. FIG. 9 is a perspective view of a presser 49V as another one of the third variations of the presser 49 depicted in FIG. 5. As illustrated in FIGS. 8 and 9, each of the pressers 49U and 49V includes an opening penetrating through the pressing portion 49*b*. For example, as illustrated in FIG. 8, the presser 49U includes a plurality of slots 49*c*1 serving as openings penetrating through the pressing portion 49*b*. As illustrated in FIG. 9, the presser 49V includes a plurality of slits 49*c*2 serving as openings penetrating through the pressing portion 49*b*. Accordingly, each of the pressers 49U and 49V has a decreased thermal capacity that shortens the waiting time for the user to wait until the fixing belt 43 is heated to the target temperature and saves energy.

As illustrated in FIG. 5, a front edge 49*f* of the pressing portion 49*b* of the presser 49 is disposed in proximity to the fixing roller 41. A border N2*s* is interposed between the fixing nip N1 and the post nip N2 in the sheet conveyance direction DP. At the post nip N2, the pressing portion 49*b* of the presser 49 presses the fixing belt 43 against the pressure roller 45. Conversely, at the border N2*s*, no component disposed inside the loop formed by the fixing belt 43 presses the fixing belt 43 against the pressure roller 45. Pressure with which the fixing belt 43 presses against the pressure roller 45 at the border N2*s* is smaller than pressure with which the fixing belt 43 presses against the pressure roller 45 at the post nip N2.

If pressure exerted at the border N2*s* disposed upstream from the post nip N2 in the sheet conveyance direction DP is smaller than pressure exerted at the post nip N2, disadvantages may generate as described below. Since pressure exerted to the sheet P at the border N2*s* is smaller than pressure exerted to the sheet P at the fixing nip N1, the sheet P discharges steam at the border N2*s*. Accordingly, air bubbles generate between the sheet P and the fixing belt 43 and the like. Additionally, as toner of the toner image T thermally expands, air contained in the toner of the toner image T leaks from the toner, generating air bubbles between the sheet P and the fixing belt 43. As the sheet P enters the post nip N2 exerted with pressure greater than pressure excited to the border N2*s*, the air bubbles are pushed and moved by the presser 49 pressing against the pressure roller 45 via the fixing belt 43. Thus, the air bubbles move over the surface of the sheet P. Since the toner of the toner image T on the sheet P immediately after passing through the fixing nip N1 is not solidified completely, as the air bubbles move over the surface of the sheet P, the air bubbles may damage the toner image T, resulting in formation of a faulty toner image T having variation in gloss or the like.

To address this circumstance, the presser 49 presses the fixing belt 43 against the pressure roller 45 in an elongated span extending to a position in proximity to the fixing nip N1 to decrease the border N2*s*. The decreased border N2*s* suppresses generation of the air bubbles. For example, according to this exemplary embodiment, the presser 49 includes a downstream end 49*h* in the rotation direction D43 of the fixing belt 43, serving as a fixed end, mounted on the support plate 24 and extending toward the pressure roller 45; the intermediate portion 40*i* bent toward the fixing nip N1; and an upstream end 49*j* in the rotation direction D43 of the fixing belt 43, serving as a free end. Compared to a configuration in which the presser 49 is bent and directed in the sheet conveyance direction DP, not directed to the fixing nip N1, such that the downstream end 49*h* of the presser 49 in the rotation direction D43 of the fixing belt 43 is a free end, the presser 49 depicted in FIG. 5 is disposed in proximity to the fixing nip N1, decreasing the border N2*s*.

Similarly, in order to address the disadvantages described above, pressure exerted from the presser 49 to the fixing belt 43 is even or decreases in the sheet conveyance direction DP to cause pressure exerted from a downstream portion (e.g., the intermediate portion 49*i*) of the presser 49 in the sheet conveyance direction DP to be not greater than pressure exerted from an upstream portion (e.g., the upstream end 49*j*) of the presser 49 in the sheet conveyance direction DP. Accordingly, air bubbles produced by steam discharged from the sheet P are not pushed out of the post nip N2 and do not move over the surface of the sheet P. Consequently, the presser 49 suppresses formation of a faulty toner image T having variation in gloss or the like at the post nip N2.

Table 2 below illustrates a result of an evaluation test of a length of the border N2*s* in the sheet conveyance direction DP.

TABLE 2

| Border N2s (mm) | Surface pressure exerted at border N2s (N/cm$^2$) | Prevention of variation in gloss of toner image |
|---|---|---|
| 5 | 3 | Very poor |
| 3 | 4 | Poor |
| 2.8 | 5 | Good (no variation in gloss) |
| 2.3 | 7 | Good (no variation in gloss) |
| 0 | 8 | Good (no variation in gloss) |

The evaluation test was performed with a solid toner image formed on an A3 size sheet under surface pressure of 40 [N/cm$^2$] exerted at the fixing nip N1 and surface pressure of 2.84 [N/cm$^2$] (0.29 [kg/cm$^2$]) exerted at the post nip N2. The solid toner image was visually checked to evaluate variation in gloss. Each of the surface pressures was measured with I-SCAN. In the "Prevention of variation in gloss of toner image" column of Table 2, good indicates that variation in gloss was not identified and evaluation is leveled as good. Very poor and poor indicate that variation in gloss was identified and evaluation is leveled as very poor or poor. The surface pressure exerted at the border N2*s* indicates an average pressure of pressures exerted in a span from the exit N1*e* of the fixing nip N1 to the front edge 49*f*, that is, an upstream edge, of the presser 49 in the rotation direction D43 of the fixing belt 43. The surface pressure exerted at the post nip N2 indicates an average pressure of pressures exerted in a span from the front edge 49*f* to a downstream end (e.g., the intermediate portion 49*i*) of the presser 49 in the rotation direction D43 of the fixing belt 43. The surface pressure exerted at the post nip N2 slightly decreases from an upstream end to a downstream end of the post nip N2 in the rotation direction D43 of the fixing belt 43. The surface pressure exerted at the upstream end of the post nip N2 in the rotation direction D43 of the fixing belt 43 is about 8 [N/cm$^2$].

As illustrated in Table 2, if the length of the border N2*s* in the rotation direction D43 of the fixing belt 43 is not greater than 2.8 mm, generation of air bubbles is suppressed at the border N2*s*, preventing air bubbles from being pushed to the post nip N2 and moving over the surface of the sheet P. As a result, no variation in gloss appears on the solid toner image, attaining evaluation leveled as good.

As illustrated in FIG. 5, a tangent X1 to the pressure roller 45 at the exit N1*e* of the fixing nip N1 and a tangent X2 to the fixing roller 41 form an angle θ not smaller than 45 degrees. The evaluation test was performed with the angle θ of 13 degrees and 45 degrees. When the angle θ was 13 degrees, variation in gloss appeared. Conversely, when the angle θ was 45 degrees, variation in gloss did not appear. When the angle θ is 13 degrees, the sheet P conveyed through the position in proximity to the exit N1*e* of the fixing nip N1 is spaced apart from the fixing roller 41 with a small distance therebetween. Accordingly, the sheet P ejected from the fixing nip N1 is susceptible to heat from the fixing roller 41. Consequently, an amount of steam discharged from the sheet P at the border N2*s* and an amount of thermal expansion of air contained in toner of the toner image T on the sheet P increase and therefore the size of an air bubble generated at the border N2*s* increases easily. Hence, even if a difference between the surface pressure exerted at the border N2*s* and the surface pressure exerted at the post nip N2 is small, since the volume of the air bubble is great, the air bubble may be spread or enlarged as the air bubble receives pressure at the post nip N2, thus generating variation in gloss of the toner image T on the sheet P. Conversely, when the angle θ is not smaller than 45 degrees, the sheet P is less susceptible to heat from the fixing roller 41 at the border N2*s*. Accordingly, the amount of steam discharged from the sheet P at the border N2*s* and the amount of thermal expansion of air contained in toner of the toner image T on the sheet P decrease and therefore the size of the air bubble generated at the border N2*s* does not increase. Consequently, the air bubble may barely be spread or enlarged as the air bubble receives pressure at the post nip N2. Thus, variation in gloss of the toner image T on the sheet P is not identified.

A detailed description is now given of a configuration of the fixing roller 41.

The fixing roller 41 is requested to rotate at high speed to improve productivity of the fixing device 40. If the presser 49 contacts the fixing roller 41 while the fixing roller 41 rotates at high speed, the presser 49 degrades rotation of the fixing roller 41, increasing a load torque imposed on the fixing roller 41. Additionally, the presser 49 may shave the outer circumferential surface of the fixing roller 41, degrading durability of the fixing roller 41 and causing breakage of the fixing roller 41. To address this circumstance, the presser 49 is requested to be isolated from the fixing roller 41. On the other hand, the presser 49 is requested to be in proximity to the fixing nip N1 to suppress variation in gloss of the toner image T as described above.

If the fixing roller 41 is a hard roller having a hardness greater than a hardness of the pressure roller 45 to allow the pressure roller 45 to deform as the pressure roller 45 is pressed against the fixing roller 41 via the fixing belt 43, a gap provided between the fixing roller 41 and the inner circumferential surface of the fixing belt 43 and situated downstream from the exit N1*e* of the fixing nip N1 in the sheet conveyance direction DP increases gradually from the exit N1*e* of the fixing nip N1 so that the gap has a wedge shape. Accordingly, the gap provided between the fixing roller 41 and the inner circumferential surface of the fixing belt 43 and situated in proximity to the exit N1*e* of the fixing nip N1 is smaller than a thickness of the presser 49 that is platy. If the presser 49 comes into contact with the outer circumferential surface of the fixing roller 41, the front edge 49*f* of the presser 49 may damage the outer circumferential surface of the fixing roller 41. To address this circumstance, the presser 49 is requested to be isolated from the fixing roller 41. However, the presser 49 is not placed in the wedge-shaped gap provided between the fixing roller 41 and the inner circumferential surface of the fixing belt 43 and situated in proximity to the exit N1*e* of the fixing nip N1 because the gap is smaller than the thickness of the presser 49 that is platy. Further, in order to prevent the presser 49 from contacting the fixing roller 41 due to tolerance of parts and assembly errors, the free end of the presser 49 is spaced apart from the exit N1*e* of the fixing nip N1. To address this circumstance, the fixing roller 41 is constructed of a core bar and an elastic layer. A hardness of the fixing roller 41 is smaller than a hardness of the pressure roller 45 so that the elastic layer of the fixing roller 41 is deformed by pressure from the pressure roller 45.

Figure 10:
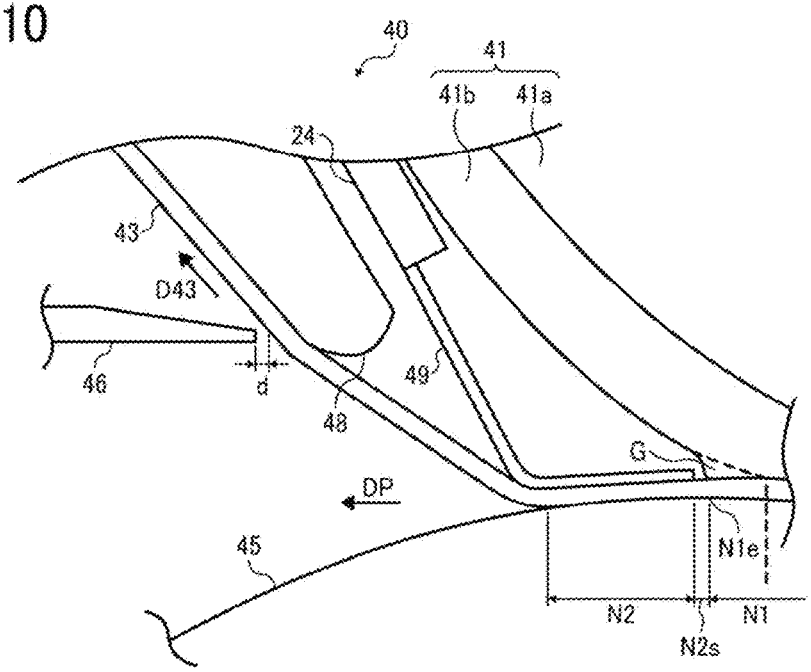
FIG. 10 is a partially enlarged, vertical cross-sectional view of the fixing device depicted in FIG. 2, illustrating components situated in proximity to an exit of a fixing nip and a fixing roller.

FIG. 10 is a partially enlarged, vertical cross-sectional view of the fixing device 40, illustrating components situated in proximity to the exit N1*e* of the fixing nip N1 and the fixing roller 41. As illustrated in FIG. 10, the fixing roller 41 is constructed of a core bar 41*a* and an elastic layer 41*b* coating the core bar 41*a*. The elastic layer 41*b* is made of silicone rubber having a thickness of about 20 mm. The fixing roller 41 has an Asker C hardness of 42 plus and minus 3 Hs that is smaller than an Asker C hardness of 68 plus and minus 3 Hs of the pressure roller 45.

As the pressure roller 45 is pressed against the fixing roller 41 via the fixing belt 43, the elastic layer 41*b* of the fixing roller 41 is deformed and fills in a wedge-shaped gap G indicated by a dotted line in FIG. 10 and provided between the fixing roller 41 and the fixing belt 43. At the exit N1*e* of the fixing nip N1, the outer circumferential surface of the fixing roller 41 is contoured to bulge sharply from the inner circumferential surface of the fixing belt 43. Accordingly, as illustrated in FIG. 10, the free end of the presser 49 is disposed in proximity to the fixing nip N1 such that the presser 49 is isolated from the outer circumferential surface of the fixing roller 41, thus decreasing the border N2*s*.

Consequently, at the border N2*s*, the amount of steam discharged from the sheet P and the amount of thermal expansion of air contained in toner of the toner image T on the sheet P decrease, suppressing generation of air bubbles precisely and suppressing variation in gloss of the toner image T on the sheet P further.

In order to elastically deform the elastic layer 41*b* of the fixing roller 41 precisely, the hardness of the fixing roller 41 is not greater than the hardness of the pressure roller 45. If the hardness of the pressure roller 45 is smaller than the hardness of the fixing roller 41, the pressure roller 45 may deform elastically and may barely exert pressure to the fixing roller 41 that is great enough to deform the elastic layer 41*b* of the fixing roller 41. Accordingly, the outer circumferential surface of the fixing roller 41 at the exit N1*e* of the fixing nip N1 is contoured to separate gradually from the fixing belt 43. The gap between the fixing belt 43 and the fixing roller 41 at the position in proximity to the exit N1*e* of the fixing nip N1 is enlarged gradually from the exit N1*e* of the fixing nip N1 to define the wedge-shaped gap G. Hence, the presser 49 may not be situated in proximity to the fixing nip N1. According to this exemplary embodiment, the Asker C hardness of 42 plus and minus 3 Hs of the fixing roller 41 is smaller than the Asker C hardness of 68 plus and minus 3 Hs of the pressure roller 45 by about 20 Hs. Since the hardness of the fixing roller 41 is smaller than the hardness of the pressure roller 45, the pressure roller 45 deforms the elastic layer 41*b* of the fixing roller 41 precisely. Accordingly, at the exit N1*e* of the fixing nip N1, the outer circumferential surface of the fixing roller 41 is contoured to bulge sharply from the inner circumferential surface of the fixing belt 43. Thus, the presser 49 is situated in proximity to the fixing nip N1.

If the presser 49 brings the fixing belt 43 into contact with the pressure roller 45 constantly, the presser 49 exerts pressure to the fixing belt 43 and the pressure roller 45 constantly, shortening the life of the fixing belt 43 and the pressure roller 45. Additionally, if the presser 49 brings the fixing belt 43 into contact with the pressure roller 45 when the fixing belt 43 is driven and rotated while no sheet P is conveyed through the fixing device 40, for example, while the fixing device 40 is warmed up, the presser 40 frictionally contacting the inner circumferential surface of the fixing belt 43 may cause the fixing belt 43 to suffer from abrasion earlier. To address this circumstance, while no sheet P is conveyed through the fixing device 40 or while a sheet P, such as thick paper and an OHP transparency that is not susceptible to waving due to discharging and absorption of steam, is conveyed through the fixing device 40, the presser 49 does not contact the fixing belt 43. When thick paper is conveyed through the fixing device 40, a leading edge of the thick paper may strike the free end of the presser 49 via the fixing belt 43, bending or directing the free end of the presser 49 downstream in the sheet conveyance direction DP or the fixing belt 43 may be sandwiched between the leading edge of the thick paper and the free end of the presser 49, damaging the fixing belt 43. To address this circumstance, when thick paper is conveyed through the fixing device 40, the presser 49 is situated at an isolation position where the presser 49 isolates the fixing belt 43 from the pressure roller 45.

A description is provided of a construction of a mover 20 that moves the presser 49 between a contact position where the presser 49 brings the fixing belt 43 into contact with the pressure roller 45 and the isolation position where the presser 49 isolates the fixing belt 43 from the pressure roller 45.

Figure 11:
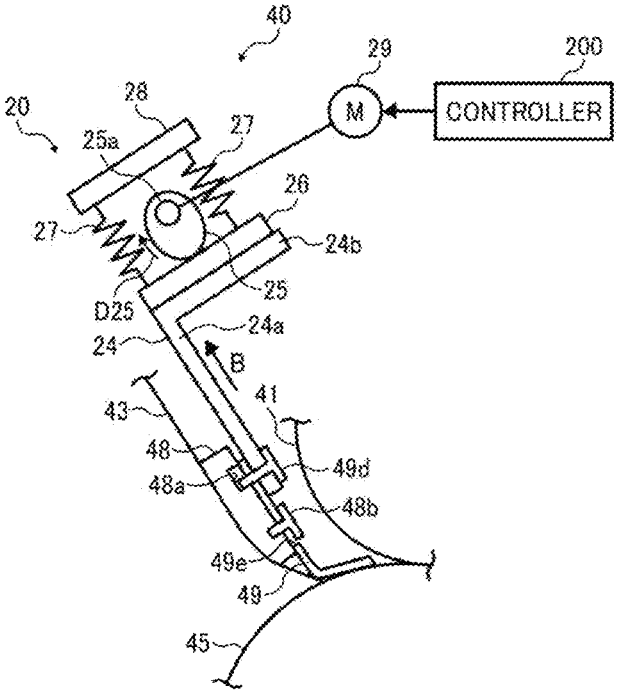
FIG. 11 is a partial schematic vertical cross-sectional view of the fixing device depicted in FIG. 2, illustrating the presser situated at a contact position and a mover that moves the presser.

FIG. 11 is a partial vertical cross-sectional view of the fixing device 40, illustrating the mover 20. As illustrated in FIG. 11, the presser 49 is fastened to the support plate 24 with a step screw 49*d*. The support plate 24 is attached to a side plate of the fixing device 40 such that the support plate 24 is movable in a predetermined range in a direction B. The separation aid 48 is fastened to the presser 49 with a step screw 48*b*. For example, an elongate through hole 49*e* penetrates through the presser 49 and extends in the direction B. The step screw 48*b* is inserted into and secured to the separation aid 48 through the elongate through hole 49*e*. The separation aid 48 includes an opposed face disposed opposite the fixing roller 41 and mounting a clearance groove 48*a* that releases a front end of the step screw 49*d* fastening the presser 49 to the support plate 24. The clearance groove 48*a* extends in the direction B. The step screw 49*d* penetrates through the support plate 24 and the presser 49. The front end of the step screw 49*d* is inside the clearance groove 48*a*.

The support plate 24 includes a base portion 24*a* that is substantially parallel to the fixing belt 43 and a bent portion 24*b* bent relative to the base portion 24*a*. The bent portion 24*b* is disposed opposite the pressure roller 45 via the base portion 24*a* and bent toward the fixing roller 41. A cam contact 26 is mounted on each lateral end of the bent portion 24*b* in the axial direction of the fixing roller 41. The cam contact 26 contacts a cam 25. The cam 25 is interposed between a pair of tension springs 21. One end of each of the tension springs 27 is anchored to the cam contact 36. Another end of each of the tension springs 27 is anchored to a spring support 28. The tension springs 27 bias the support plate 24 in a separation direction in which the support plate 24 separates from the pressure roller 45. The cam 25 is attached to both lateral ends of a driving shaft 25*a* in an axial direction thereof. The driving shaft 25*a* is coupled to a motor 29. The motor 29 is operatively connected to a controller 200 that controls the motor 29. For example, the controller 200 (e.g., a processor) is a central processing unit (CPU) provided with a random-access memory (RAM) and a read-only memory (ROM). The controller 200 may be situated inside the fixing device 40 or the image forming apparatus 1000.

Figure 12:
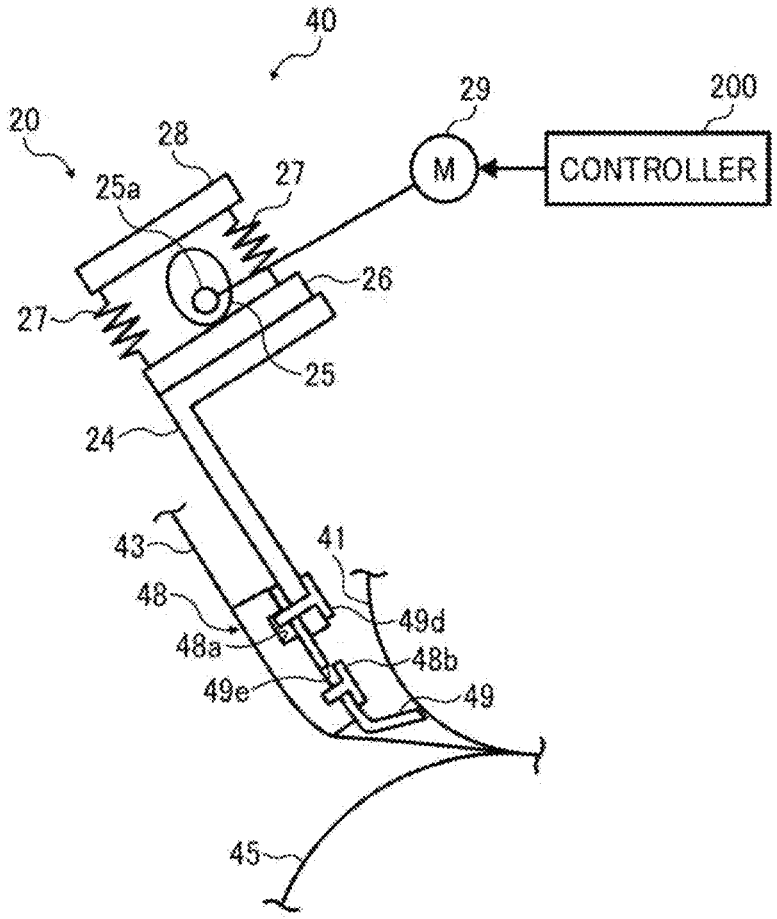
FIG. 12 is a partial vertical cross-sectional view of the fixing device depicted in FIG. 2, illustrating the presser situated at an isolation position.

FIG. 12 is a partial vertical cross-sectional view of the fixing device 40, illustrating the isolation position of the presser 49. As the controller 200 drives the motor 29 to rotate the cam 25 clockwise in FIG. 11 in a rotation direction D25 from the contact position depicted in FIG. 11, a bias applied by the tension springs 27 moves the support plate 24 and the presser 49 supported by the support plate 24 in the separation direction in which the support plate 24 and the presser 49 separate from the pressure roller 45. The presser 49 moves in a separation direction in which the presser 49 separates from the pressure roller 45. As illustrated in FIG. 12, after the cam 25 rotates by 180 degrees from the contact position depicted in FIG. 11, the presser 49 reaches the isolation position where the presser 49 does not press the fixing belt 43 against the pressure roller 45, thus eliminating the post nip N2.

A description is provided of one example of a control method for moving the presser 49.

Figure 13:
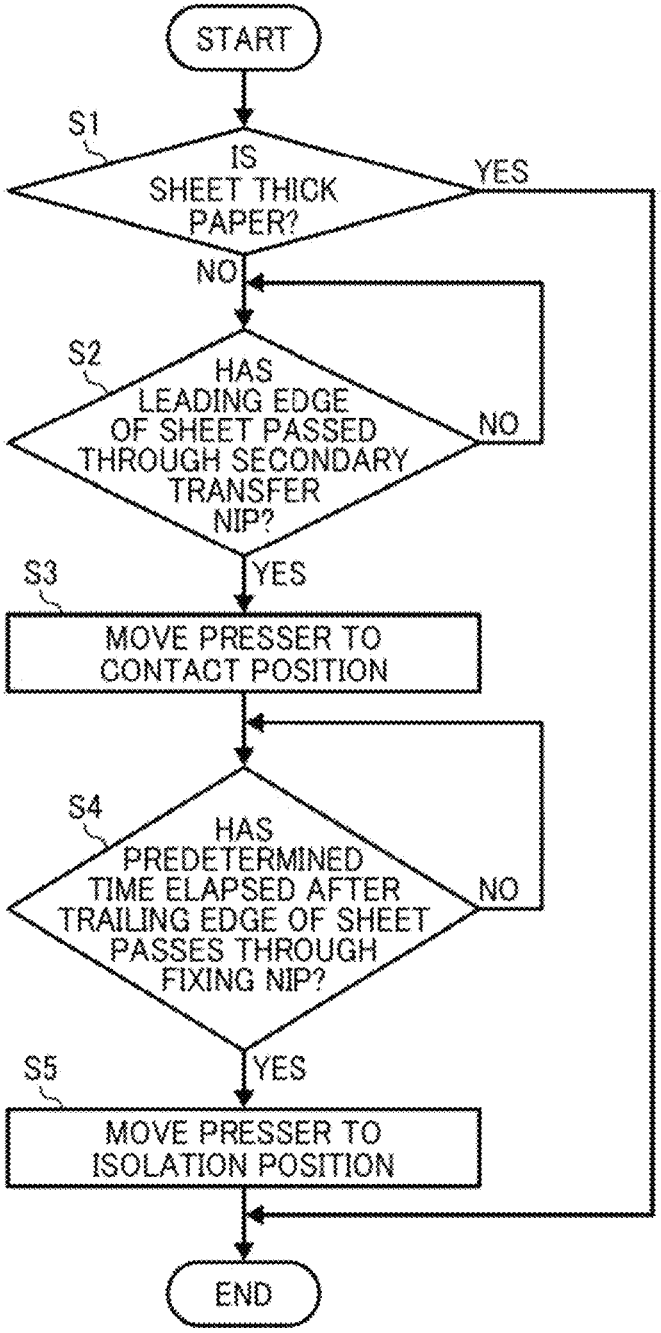
FIG. 13 is a flow chart illustrating one example of a control method for moving the presser depicted in FIGS. 11 and 12.

FIG. 13 is a flowchart illustrating control processes of the control method for moving the presser 49.

As an image forming operation of the image forming apparatus 1000 depicted in FIG. 1 starts, the controller 200 depicted in FIG. 11 determines whether a sheet P conveyed toward the fixing device 40 is thick paper or not in step S1. According to this exemplary embodiment, a sheet P having a paper weight not smaller than 164 [gsm] is defined as thick paper.

If the controller 200 determines that the sheet P conveyed toward the fixing device 40 is not thick paper (NO in step S1), the controller 200 determines whether or not the leading edge of the sheet P has passed through the secondary transfer nip formed between the intermediate transfer belt 61 and the secondary transfer belt 77 depicted in FIG. 1 in step S2.

If the controller 200 determines that the leading edge of the sheet P has passed through the secondary transfer nip (YES in step S2), the controller 200 drives the motor 29 to cause the mover 20 to move the presser 49 from the isolation position depleted in FIG. 12 to the contact position depicted in FIG. 11 in step S3.

For example, when a predetermined time has elapsed after the registration roller pair 34 depicted in FIG. 5 starts rotation, the mover 20 starts moving the presser 49 from the isolation position depicted in FIG. 12 to the contact position depicted in FIG. 11. According to this exemplary embodiment, when the leading edge of the sheet P has passed through the secondary transfer nip, the mover 20 moves the presser 49 from the isolation position depicted in FIG. 12 to the contact position depicted in FIG. 11. Alternatively, the mover 20 may move the presser 49 to the contact position depicted in FIG. 11 at other time as long as the move 20 finishes moving the presser 49 to the contact position before the leading edge of the sheet P enters the fixing nip N1. However, in order to decrease a load imposed on the fixing belt 43 and the pressure roller 45, the mover 20 preferably starts moving the presser 49 such that the presser 49 reaches the contact position immediately before the leading edge of the sheet P enters the fixing nip N1.

As described above, in a transfer process when the toner image T is transferred onto the sheet P, that is, an image forming process immediately before the sheet P is conveyed through the fixing device 40, the mover 20 starts moving the presser 49 from the isolation position depicted in FIG. 12 to the contact position depicted in FIG. 11. Accordingly, immediately before the sheet P is conveyed through the fixing device 40, the mover 20 halts the presser 49 at the contact position depicted in FIG. 11. Thus, the presser 49 does not exert pressure to the fixing belt 43 and the pressure roller 45 and thereby does not impose a load on the fixing belt 43 and the pressure roller 45. Additionally, the presser 49 does not frictionally contact the fixing belt 43, preventing abrasion of the inner circumferential surface of the fixing belt 43.

In step S4, the controller 200 determines whether or not a predetermined time has elapsed after a trailing edge of the sheet P passes through the fixing nip N1.

If the controller 200 determines that the predetermined time has elapsed after the trailing edge of the sheet P passes through the fixing nip N1 (YES in step S4), the controller 200 drives the motor 29 to cause the mover 20 to move the presser 49 from the contact position depicted in FIG. 11 to the isolation position depicted in FIG. 12 in step S5.

As one example, when the ejection sensor described above detects the trailing edge of the sheet P, the mover 20 starts moving the presser 49 to the isolation position depicted in FIG. 12. At a predetermined time after the trailing edge of the sheet P passes through the fixing device 40, the mover 20 moves the presser 49 from the contact position depleted in FIG. 11 to the isolation position depicted in FIG. 12. However, in order to decrease the load (e.g., abrasion) imposed on the fixing belt 43 and the pressure roller 45, the mover 20 preferably starts moving the presser 49 to the isolation position depicted in FIG. 12 immediately after the trailing edge of the sheet P passes through the fixing device 40.

Since the mover 20 starts moving the presser 49 to the isolation position depicted in FIG. 12 immediately after the trailing edge of the sheet P passes through the fixing device 40, the presser 49 does not exert pressure to the fixing belt 43 and the pressure roller 45 and does not impose the load on the fixing belt 43 and the pressure roller 45. Additionally, the presser 49 does not frictionally contact the fixing belt 43, preventing abrasion of the inner circumferential surface of the fixing belt 43.

If the sheet P conveyed toward the fixing nip N1 is thick paper that is not susceptible to waving (YES in step S1), the mover 20 does not move the presser 49 to the contact position depicted in FIG. 11 and retains the presser 49 at the isolation position depicted in FIG. 12. Accordingly, the presser 49 reduces the load imposed on the fixing belt 43 and the pressure roller 45, improving durability of the fixing belt 43 and the pressure roller 45. Additionally, the presser 49 decreases friction between the presser 49 and the fixing belt 43. For example, according to this exemplary embodiment, the presser 49 situated at the isolation position depicted in FIG. 12 is isolated from the inner circumferential surface of the fixing belt 43. Accordingly, the presser 49 situated at the isolation position depicted in FIG. 12 does not generate friction between the presser 49 and the inner circumferential surface of the fixing belt 43, suppressing abrasion of the fixing belt 43 further.

For example, when the thick paper used as the sheet P is conveyed through the fixing device 40, the presser 49 situated at the isolation position depicted in FIG. 12 prevents the leading edge of the thick paper in the sheet conveyance direction DP from striking the free end of the presser 49, extending the life of the fixing belt 43 and the presser 49.

The control method described above is one example. Alternatively, according to a fixing condition and a type of the sheet P, even if the sheet P has a paper weight not smaller than 164 [gsm], the mover 20 may move the presser 49 the contact position depicted in FIG. 11. For example, if the sheet P bears a solid toner image spanning on the entire surface of the sheet P and therefore having a substantial amount of toner, a substantial amount of heat is needed to fix the solid toner image on the sheet P. In this case, even if the sheet P has the paper weight not smaller than 164 [gsm], the mover 20 moves the presser 49 to the contact position depicted in FIG. 11. Since the presser 49 is situated at the contact position depicted in FIG. 11, even after the sheet P passes through the fixing nip N1, the presser 49 allows the fixing belt 43 and the pressure roller 45 to apply heat and pressure to the sheet P to fix the solid toner image on the sheet P. For example, since the presser 49 is situated at the contact position depicted in FIG. 11, even after the sheet P passes through the fixing nip N1, the presser 49 retains the fixing belt 43 in contact with the sheet P, allowing the fixing belt 43 to conduct heat to the sheet P. Additionally, the presser 49 presses the solid toner image on the sheet P against the pressure roller 45. Even if the sheet P does not receive an amount of heat great enough to fix the solid toner image on the sheet P while the sheet P passes through the fixing nip N1, the mover 20 moves the presser 49 to the contact position depicted in FIG. 11 where the presser 49 presses the fixing belt 43 against the sheet P at the post nip N2 to allow the fixing belt 43 to fix the solid toner image on the sheet P.

A description is provided of another example of the control method for moving the presser 49.

Figure 14:
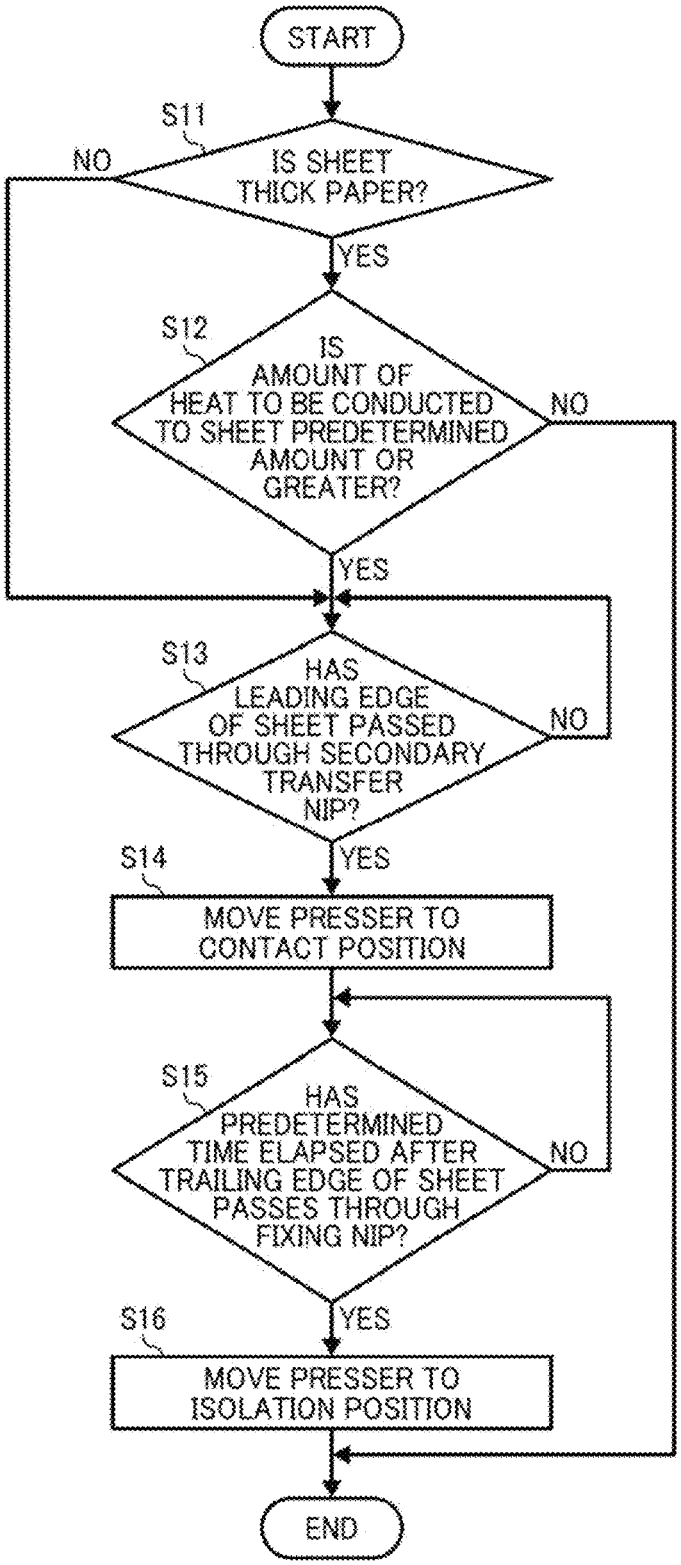
FIG. 14 is a flowchart illustrating another example of the control method for moving the presser depicted in FIGS. 11 and 12.

FIG. 14 is a flowchart illustrating control processes of the control method for moving the presser 49.

In step S11, the controller 200 determines whether or not a sheet P conveyed toward the fixing device 40 is thick paper having the paper weight not smaller than 164 [gsm].

If the controller 200 determines that the sheet P conveyed toward the fixing device 40 is thick paper (YES in step S11), the controller 200 determines whether or not an amount of heat to be conducted to the sheet P to fix a toner image T on the sheet P is a predetermined amount or greater in step S12.

The amount of heat to be conducted to the sheet P to fix the toner image T on the sheet P is calculated based on an image area rate defined based on image data, for example. If the amount of heat to be conducted to the sheet P to fix the toner image T on the sheet P is smaller than the predetermined amount (NO in step S12), the presser 49 remains at the isolation position depicted in FIG. 12.

Conversely, if the controller 200 determines that the sheet P conveyed toward the fixing device 40 is not thick paper (NO in step S11) or, even if the controller 200 determines that the sheet P conveyed toward the fixing device 40 is thick paper (YES in step S11), if the controller 200 determines that the amount of heat to be conducted to the sheet P to fix the toner image T on the sheet P is the predetermined amount or greater (YES in step S12), the controller 200 determines whether or not the leading edge of the sheet P has passed through the secondary transfer nip in step S13.

If the controller 200 determines that the leading edge of the sheet P has passed through the secondary transfer nip (YES in step S13), the mover 20 moves the presser 49 from the isolation position depicted in FIG. 12 to the contact position depicted in FIG. 11 in step S14.

The controller 200 determines whether or not a predetermined time has elapsed after the trailing edge of the sheet P passes through the fixing nip N1 in step S15.

If the controller 200 determines that the predetermined time has elapsed after the trailing edge of the sheet P passes through the fixing nip N1 (YES in step S15), the controller 200 causes the mover 20 to move the presser 49 from the contact position depicted in FIG. 11 to the isolation position depicted in FIG. 12 in step S16.

Even if the sheet P has the paper weight of 164 [gsm], if the amount of heat to be conducted to the sheet P to fix the toner image T on the sheet P is the predetermined amount or greater, the mover 20 moves the presser 49 to the contact position depicted in FIG. 11 to allow the fixing belt 43 to fix the toner image T on the sheet P properly.

If the sheet P is an OHP transparency, for example, the presser 49 may be situated at the isolation position depicted in FIG. 12 regardless of the thickness defined by the paper weight of the sheet P. For example, the controller 200 includes a memory 200*a* (e.g., a non-volatile memory) depicted in FIG. 15 that stores sheet type information about the type of the sheet P and position information about whether or not to move the presser 49 to the isolation position depicted in FIG. 12 that relates to the sheet type information. The controller 200 determines whether or not to move the presser 49 to the isolation position depicted in FIG. 12 based on the information stored in the memory 200*a*. For example, the user specifies the type of the sheet P to be conveyed to the fixing device 40 with a control panel of the image forming apparatus 1000, application software installed in a client computer, or the like. The controller 200 determines to which position the mover 20 moves the presser 49, the isolation position depicted in FIG. 12 or the contact position depicted in FIG. 11, according to the type of the sheet P that is specified by the user and the information stored by the memory 200*a*. In order 10 move the presser 49 to the contact position depicted in FIG. 11, when the controller 200 determines that the leading edge of the sheet P has passed through the secondary transfer nip (YES in step S2 in FIG. 13 and YES in step S13 in FIG. 14), the controller 200 causes the mover 20 to move the presser 49 to the contact position depicted in FIG. 11 in step S3 in FIG. 13 and step S14 in FIG. 14.

A description is provided of a construction of a pressurization assembly 201 incorporated in the fixing device 40.

Figure 15:
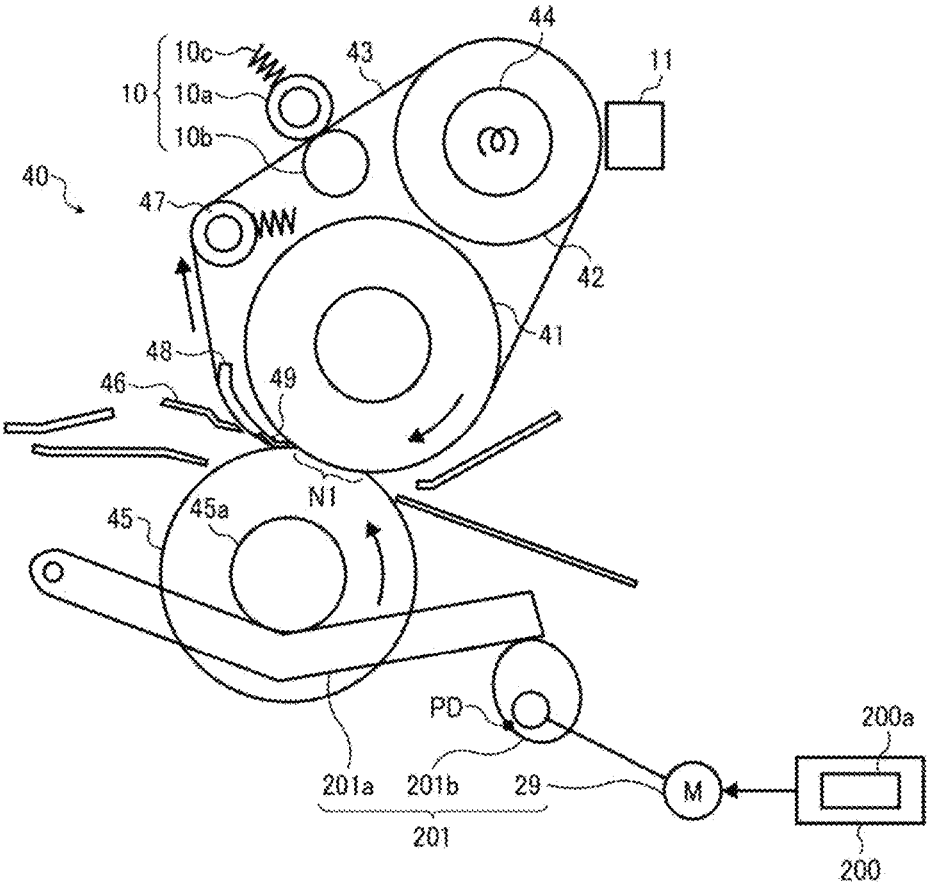
FIG. 15 is a schematic vertical cross-sectional view of the fixing device depleted in FIG. 2, illustrating a pressurization assembly incorporated therein.

FIG. 15 is a schematic vertical cross-sectional view of the fixing device 40, illustrating the pressurization assembly 201. As illustrated in FIG. 15, the pressurization assembly 201 includes a pressing arm 201*a*, a pressing cam 201*b*, and the motor 29 serving as a driver. The pressing arm 201*a* contacts a core bar 45*a* of the pressure roller 45. One end of the pressing arm 201*a* is rotatably supported. The pressing cam 201*b* contacts another end of the pressing arm 201*a*. As the motor 29 rotates the pressing cam 201*b*, the pressing cam 201*b* moves the pressing arm 201*a* in contact with the pressing cam 201*b*. The pressing arm 201*a* moves the pressure roller 45 to press the pressure roller 45 against the fixing roller 41 via the fixing belt 43 and release pressure exerted from the pressure roller 45 to the fixing roller 41 via the fixing belt 43. The motor 29 is operatively connected to the controller 200 that controls the motor 29. After a fixing job is finished, the motor 29 drives the pressing cam 201*b* to move the pressure roller 45 from a pressurization position where the pressure roller 45 is pressed against the fixing roller 41 via the fixing belt 43 to a depressurization position, where the pressure roller 45 is isolated from the fixing belt 43. Accordingly, the pressurization assembly 201 reduces load imposed on the pressure roller 45, the fixing belt 43, and the fixing roller 41, improving durability of the pressure roller 45, the fixing belt 43, and the fixing roller 41.

The controller 200 changes a pressing position of the pressure roller 45 pressed against the fixing belt 43 according to the thickness of the sheet P conveyed toward the fixing device 40, the type of the sheet P such as an envelope, image data, and the like, thus adjusting pressure exerted from the pressure roller 45 to the fixing belt 43. For example, the controller 200 controls the motor 29 of the pressurization assembly 201 to change a rotation angle of the pressing cam 201*b*, thus changing the pressing position of the pressure roller 45 and adjusting pressure exerted from the pressure roller 45 to the fixing belt 43. Hence, the pressurization assembly 201 serves as a pressure adjuster.

For example, if the sheet P conveyed toward the fixing device 40 is thick paper, the pressure roller 45 moves to a distal pressing position where a rotation axis of the pressure roller 45 separates from the fixing roller 41 farther than at a reference pressing position of the pressure roller 45, thus reducing pressure exerted from the pressure roller 45 to the fixing belt 43. As described above, when the sheet P is thick paper, the mover 20 moves the presser 49 to the isolation position depleted in FIG. 12. Even if the sheet P is thick paper, if the amount of heat to be conducted to the sheet P to fix the toner image T on the sheet P is the predetermined amount or greater, the mover 20 moves the presser 49 to the contact position depicted in FIG. 11. The pressure roller 45 moves to the distal pressing position where the rotation axis of the pressure roller 45 separates from the fixing roller 41 farther than at the reference pressing position of the pressure roller 45, thus reducing pressure exerted from the pressure roller 45 to the fixing belt 43. However, when the pressure roller 45 is situated at the distal pressing position where the rotation axis of the pressure roller 45 separates from the fixing roller 41 farther than at the reference pressing position of the pressure roller 45, the presser 49 presses the fixing belt 43 against the pressure roller 45 with pressure smaller than predetermined pressure. Accordingly, the presser 49 may not suppress waving of the sheet P precisely. As the presser 49 deforms resiliency with a reduced deformation amount, the front edge 49*f* of the presser 49 separates from the fixing nip N1. As pressure with which the pressure roller 45 is pressed against the fixing roller 41 via the fixing belt 43 decreases, a length of the fixing nip N1 in the sheet conveyance direction DP decreases. Accordingly, the length of the border N2*s* in the rotation direction D43 of the fixing belt 43 is 2.8 mm or more, causing variation in gloss of the toner image T on the sheet P.

If the sheet P is plain paper bearing a toner image T made of toner in a substantial amount, for example, and therefore a substantial amount of heat is to be conducted to the sheet P through the fixing belt 43 to fix the toner image T on the sheet P properly, the pressure roller 45 moves to a proximal pressing position where the pressure roller 45 is closer to the fixing roller 41 compared to when the pressure roller 45 is situated at the reference pressing position. Accordingly, pressure with which the pressure roller 45 is pressed against the fixing roller 41 via the fixing belt 43 increases and thereby the length of the fixing nip N1 in the rotation direction D43 of the fixing belt 43 increases. The increased length of the fixing nip N1 allows the fixing belt 43 to conduct an increased amount of heat to the toner image T on the sheet P conveyed through the fixing nip N1. Accordingly, the fixing belt 43 fixes the toner image T on the sheet P properly even if the toner image T is made of toner in a substantial amount. However, when the presser 49 is situated at the contact position depicted in FIG. 11, the pressure roller 45 may increase an amount of resilient deformation of the presser 49, causing the front edge 49*f* of the presser 49 to be closer to the fixing roller 41. Further, the increased length of the fixing nip N1 may bring the presser 49 into contact with the fixing roller 41, rendering the presser 49 to scratch or shave the outer circumferential surface of the fixing roller 41.

To address this circumstance, according to this exemplary embodiment, the controller 200 adjusts the contact position of the presser 49 according to the pressing position (e.g., the distal pressing position and the proximal pressing position) of the pressure roller 45 where the pressure roller 45 is pressed against the fixing roller 41 via the fixing belt. 43. For example, the controller 200 controls the motor 29 depicted in FIGS. 11 and 12 that drives the mover 20 to change a rotation angle of the cam 25 according to the pressing position of the pressure roller 45, thus adjusting the contact position of the presser 49. Hence, the mover 20 serves as a presser position adjuster.

Figure 16A:
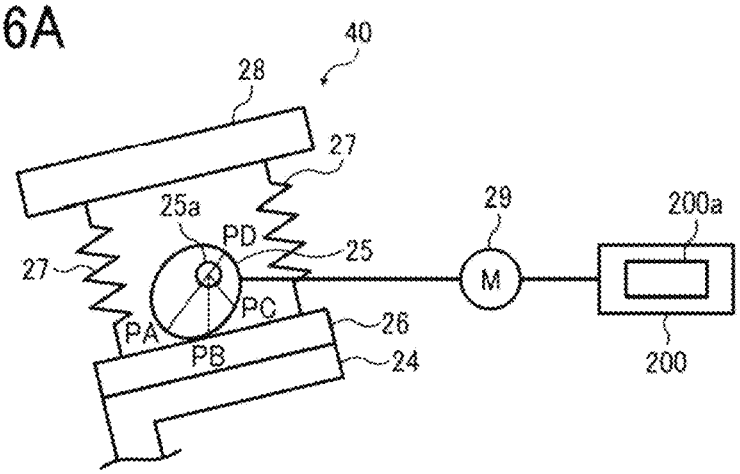
FIG. 16A is a partial vertical cross-sectional view of the fixing device depicted in FIG. 2 when a point PB of a cam of the mover contacts a cam contact.
Figure 16B:
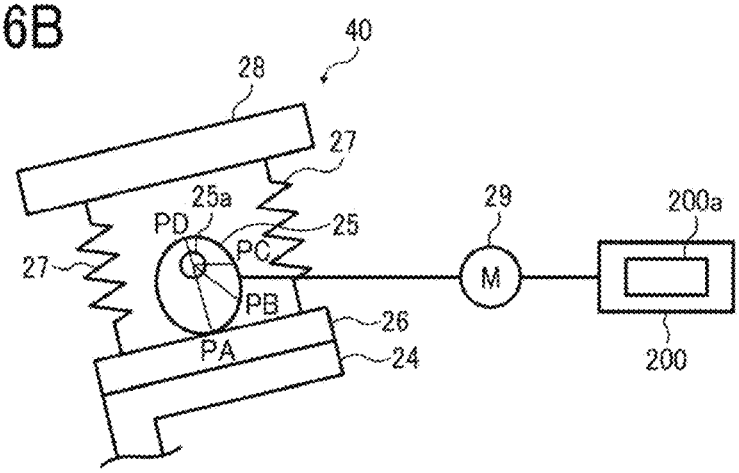
FIG. 16B is a partial vertical cross-sectional view of the fixing device depicted in FIG. 2 when a point PA of the cam of the mover contacts the cam contact.
Figure 16C:
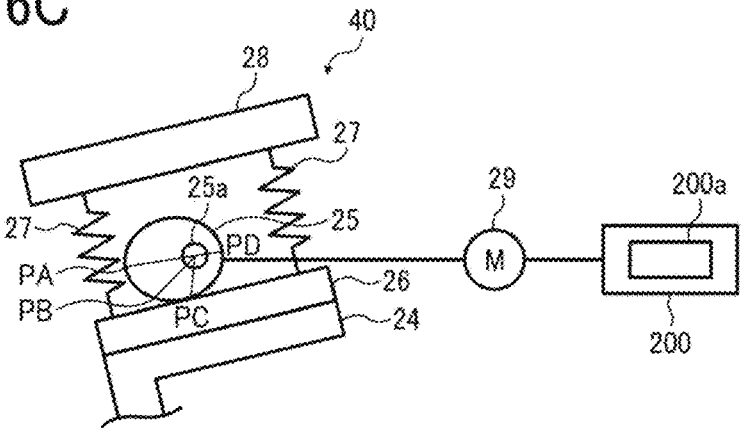
FIG. 16C is a partial vertical cross-sectional view of the fixing device depicted in FIG. 2 when a point PC of the cam of the mover contacts the cam contact.

Referring to FIGS. 16A, 16B, and 16C, a description is provided of a relation between the contact position of the presser 49 and a rotation position of the cam 25.

When the presser 49 is situated at the isolation position, a bottom dead point PD of the cam 25 contacts the cam contact 26. The memory 200*a* of the controller 200 stores a driving amount of the motor 29 to rotate the cam 25 from the bottom dead point PD to each of points PA, PB, and PC as illustrated in FIGS. 16A, 16B, and 16C.

In order to move the presser 49 to the contact position while the pressing position of the pressure roller 45 is the reference pressing position, the controller 200 retrieves from the memory 200*a* the driving amount of the motor 29 to rotate the cam 25 from the bottom dead point PD to the point PB. The controller 200 drives the motor 29 according to the retrieved driving amount to bring the point PB of the cam 25 into contact with the cam contact 26 as illustrated in FIG. 16A. FIG. 16A is a partial vertical cross-sectional view of the fixing device 40 when the point PB of the cam 25 contacts the cam contact 26. As the point PB of the cam 25 comes into contact with the cam contact 26, the controller 200 stops driving the motor 29. Thus, the presser 49 contacts the fixing belt 43 at a reference contact position.

In order to move the presser 49 to the contact position while the pressing position of the pressure roller 45 is the distal pressing position where the pressure roller 45 separates from the fixing roller 41 farther than while the pressure roller 45 is situated at the reference pressing position, the controller 200 retrieves from the memory 200*a* the driving amount of the motor 29 to rotate the cam 25 from the bottom dead point PD to the point PA serving as a top dead point. The controller 200 drives the motor 29 according to the retrieved driving amount to bring the point PA of the cam 25 into contact with the cam contact 26 as illustrated in FIG. 16B. FIG. 16B is a partial vertical cross-sectional view of the fixing device 40 when the point PA of the cam 25 contacts the cam contact 26. As the point PA of the cam 25 comes into contact with the cam contact 26, the controller 200 stops driving the motor 29. Thus, the presser 49 contacts the fixing bolt 43 at a proximal contact position where the presser 49 is disposed closer to the pressure roller 45 than at the predetermined contact position.

Accordingly, also when the pressing position of the pressure roller 45 is the distal pressing position where the pressure roller 45 separates from the fixing roller 41 farther than at the reference pressing position, the presser 49 presses the fixing belt 43 against the pressure roller 45 with the predetermined pressure. Thus, the presser 49 presses the sheet P against the pressure roller 45 precisely after the sheet P passes through the fixing nip N1. Accordingly, the presser 49 suppresses waving of the sheet P and the streaked creases S on the sheet P depicted in FIG. 4. The presser 49 suppresses reduction in an amount of resilient deformation, preventing the front edge 49*f* of the presser 49 from separating from the fixing nip N1. Consequently, the length of the border N2*s* in the rotation direction D43 of the fixing belt 43 does not exceed 2.8 mm, suppressing variation in gloss of the toner image T on the sheet P.

In order to move the presser 49 to the contact position while the pressing position of the pressure roller 45 is the proximal pressing position where the pressure roller 45 is closer to the fixing roller 41 than while the pressure roller 45 is situated at the reference pressing position, the controller 200 retrieves from the memory 200*a* the driving amount of the motor 29 to rotate the cam 25 from the bottom dead point PD to the point PC. The controller 200 drives the motor 29 according to the retrieved driving amount to bring the point PC of the cam 25 into contact with the cam contact 26 as illustrated in FIG. 16C. FIG. 16C is a partial vertical cross-sectional view of the fixing device 40 when the point PC of the cam 25 contacts the cam contact 26. As the point PC of the cam 25 comes into contact with the cam contact 26, the controller 200 stops driving the motor 29. Thus, the presser 49 contacts the fixing belt 43 at a distal contact position where the presser 49 separates from the pressure roller 45 than at the reference contact position. Accordingly, also when the pressing position of the pressure roller 45 is the proximal pressing position where the pressure roller 45 is closer to the fixing roller 41 than at the reference pressing position, the presser 49 presses the fixing belt 43 against the pressure roller 45 with the predetermined pressure. The presser 49 suppresses increase in an amount of resilient deformation, preventing the front edge 49*f* of the presser 49 from coming into contact with the outer circumferential surface of the fixing roller 41. Thus, the presser 49 does not damage the outer circumferential surface of the fixing roller 41.

A description is provided of a construction of a mover 20*a* as a first variation of the mover 20 depicted in FIGS. 11 and 12.

Figure 17:
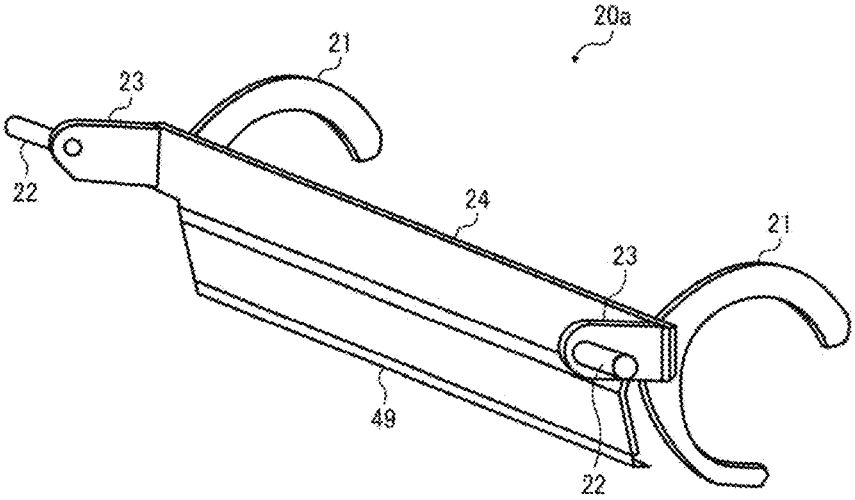
FIG. 17 is a perspective view of a mover as a first variation of the mover depicted in FIG. 11.

FIG. 17 is a perspective view of the mover 20*a*. As illustrated in FIG. 17, the mover 20*a* includes the bent support plate 24 that mounts and supports the presser 49. The presser 49 is fastened to a lower end in FIG. 17 of the support plate 24, that is, an upstream end of the support plate 24 in the rotation direction D43 of the fixing belt 43, with a screw. An arm 23 and a guide 21 are disposed at each lateral end of the support plate 24 in the axial direction of the fixing roller 41. A coupler 22 is secured to a tip portion of the arm 23 and is coupled to a driver including a cam. The coupler 22 is inserted into and supported by an arcuate, elongate hole disposed on the side face of the frame of the fixing device 40. The elongate hole causes the coupler 22 to pivot about a rotation axis of the fixing roller 41. A spring is anchored to the coupler 22 to bias the presser 49 supported by the support plate 24 against the pressure roller 45.

Figure 18:
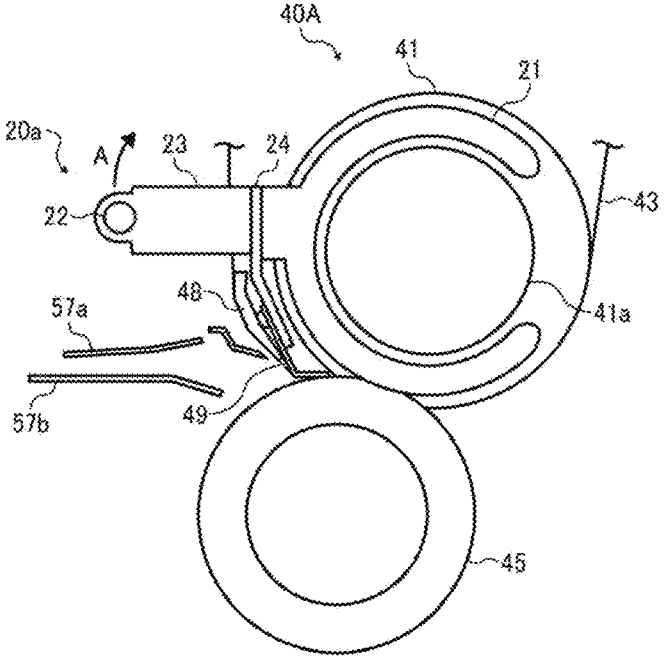
FIG. 18 is a partial vertical cross-sectional view of a fixing device incorporating the mover depicted in FIG. 17, illustrating the presser situated at the contact position.
Figure 19:
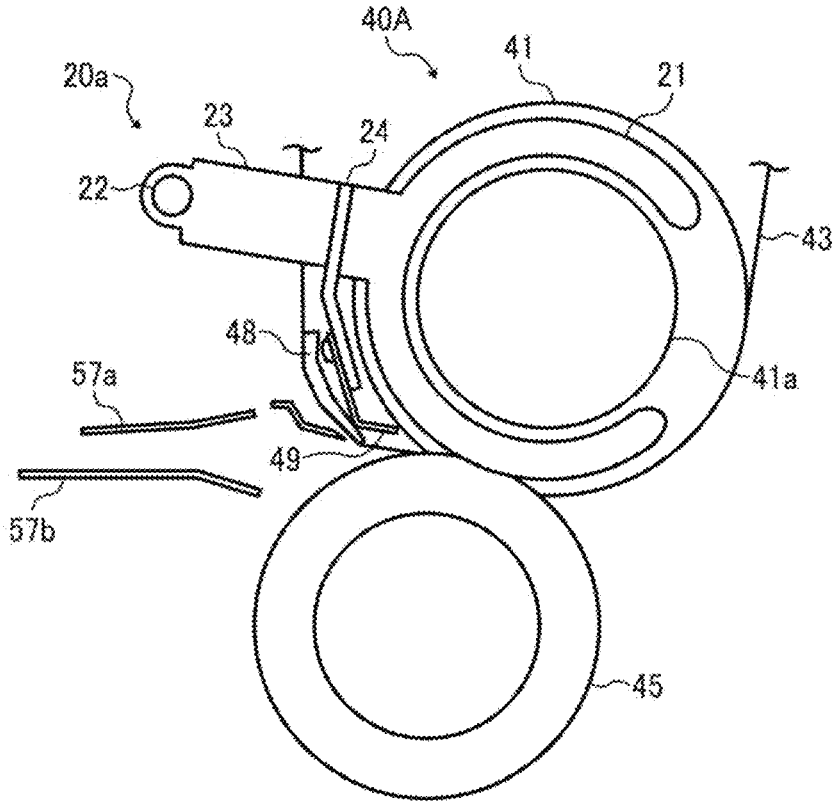
FIG. 19 is a partial vertical cross-sectional view of the fixing device depicted in FIG. 18, illustrating the presser situated at the isolation position.

FIG. 18 is a partial vertical cross-sectional view of a fixing device 40A incorporating the mover 20*a*, illustrating the contact position of the presser 49 moved by the mover 20*a*. FIG. 19 is a partial vertical cross-sectional view of the fixing device 40A, illustrating the isolation position of the presser 49 moved by the mover 20*a*.

As illustrated in FIGS. 18 and 19, the guide 21 is attached to the core bar 41*a* of the fixing roller 41. In order to move the presser 49 to the isolation position depicted in FIG. 19, the controller 200 rotates the cam of the driver to press the coupler 22 upward in FIG. 18 against a bias exerted by the spring. The mover 20*a* pivots about the rotation axis of the fixing roller 41 in a pivot direction A while the mover 20*a* is guided by the guide 21. As illustrated in FIG. 19, the presser 49 moves to the isolation position where the presser 49 is isolated from the fixing belt 43.

The mover 20*a* pivots the support plate 24 supporting the presser 49 about the rotation axis of the fixing roller 41, thus moving the presser 49 between the contact position depicted in FIG. 18 and the isolation position depicted in FIG. 19. Accordingly, the presser 49 moves between the contact position depicted in FIG. 18 and the isolation position depicted in FIG. 19 such that the presser 49 moves on an arcuate trajectory along the outer circumferential surface of the fixing roller 41. Consequently, even if the front edge 49*f* of the pressing portion 49*b* of the presser 49 is disposed in proximity to the fixing roller 41 as illustrated in FIG. 5, the front edge 49*f* does not contact the outer circumferential surface of the fixing roller 41 while the presser 49 moves to the isolation position depicted in FIG. 19. Thus, the presser 49 does not damage the outer circumferential surface of the fixing roller 41.

Also in the mover 20*a*, while the pressing position of the pressure roller 45 is the distal pressing position where the pressure roller 45 separates from the fixing roller 41 farther than while the pressure roller 45 is situated at the reference pressing position, the controller 200 adjusts a rotation position of the cam of the driver to lower the coupler 22 from a position illustrated in FIG. 18. Accordingly, the contact position of the presser 49 changes from the reference contact position depicted in FIG. 18 to the proximal contact position that is closer to the pressure roller 45 than the reference contact position, thus suppressing decrease in the amount of resilient deformation of the presser 49. Thus, the presser 49 presses the fixing belt 43 against the pressure roller 45 with predetermined pressure. Accordingly, the presser 49 suppresses waving of the sheet P. Additionally, the length of the border N2*s* in the rotation direction D43 of the fixing belt 43 is not enlarged, preventing variation in gloss from appearing on the toner image T on the sheet P.

Conversely, while the pressing position of the pressure roller 45 is the proximal pressing position where the pressure roller 45 is closer to the fixing roller 41 than while the pressure roller 45 is situated at the reference pressing position, the controller 200 adjusts the rotation position of the cam of the driver to lift the coupler 22 from the position illustrated in FIG. 18. Accordingly, the contact position of the presser 49 changes from the reference contact position depicted in FIG. 18 to the distal contact position that is separated from the pressure roller 45 farther than the reference contact position, thus suppressing increase in the amount of resilient deformation of the presser 49. Thus, the presser 49 presses the fixing belt 43 against the pressure roller 45 with the predetermined pressure. Additionally, the front edge 49*f* of the presser 49 does not contact the fixing roller 41.

If the cam of the driver is configured to contact the coupler 22 directly, the cam may overlap a sheet conveyance region enclosed by an upper ejection guide 57*a* and a lower ejection guide 57*b* depicted in FIG. 18 that are disposed downstream from the exit N1*e* of the fixing nip N1. In this case, the cam contacting one end of the coupler 22 in the axial direction of the fixing roller 41 and the cam contacting another end of the coupler 22 in the axial direction of the fixing roller 41 are attached to a rotation shaft that crosses the sheet conveyance region defined by the upper ejection guide 57*a* and the lower ejection guide 57*b*. Accordingly, the sheet P having passed through the post nip N2 may be caught by the rotation shaft and may not be conveyed properly. To address this circumstance, the cam contacting one end of the coupler 22 in the axial direction of the fixing roller 41 and the cam contacting another end of the coupler 22 in the axial direction of the fixing roller 41 may be driven by separate driving motors, respectively, increasing manufacturing costs of the fixing device 40A. Hence, in order to present the cam in direct contact with the coupler 22 from crossing the sheet conveyance region defined by the upper ejection guide 57*a* and the lower ejection guide 57*b*, the fixing device 40A may include a joint that couples the cam with the coupler 22 to place the cam outside the sheet conveyance region defined by the upper ejection guide 57*a* and the lower ejection guide 57*b*.

Figure 20:
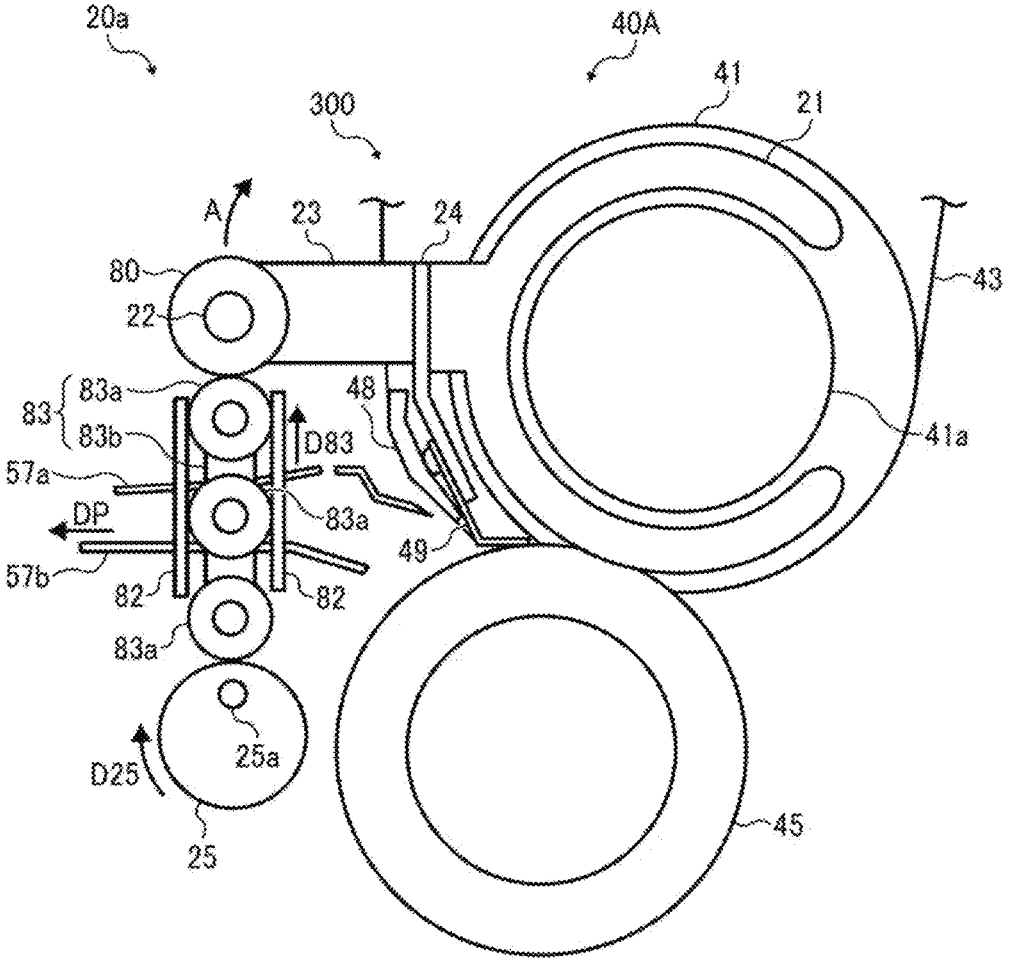
FIG. 20 is a schematic vertical cross-sectional view of the fixing device depicted in FIG. 18, illustrating a joint of the mover.
Figure 21:
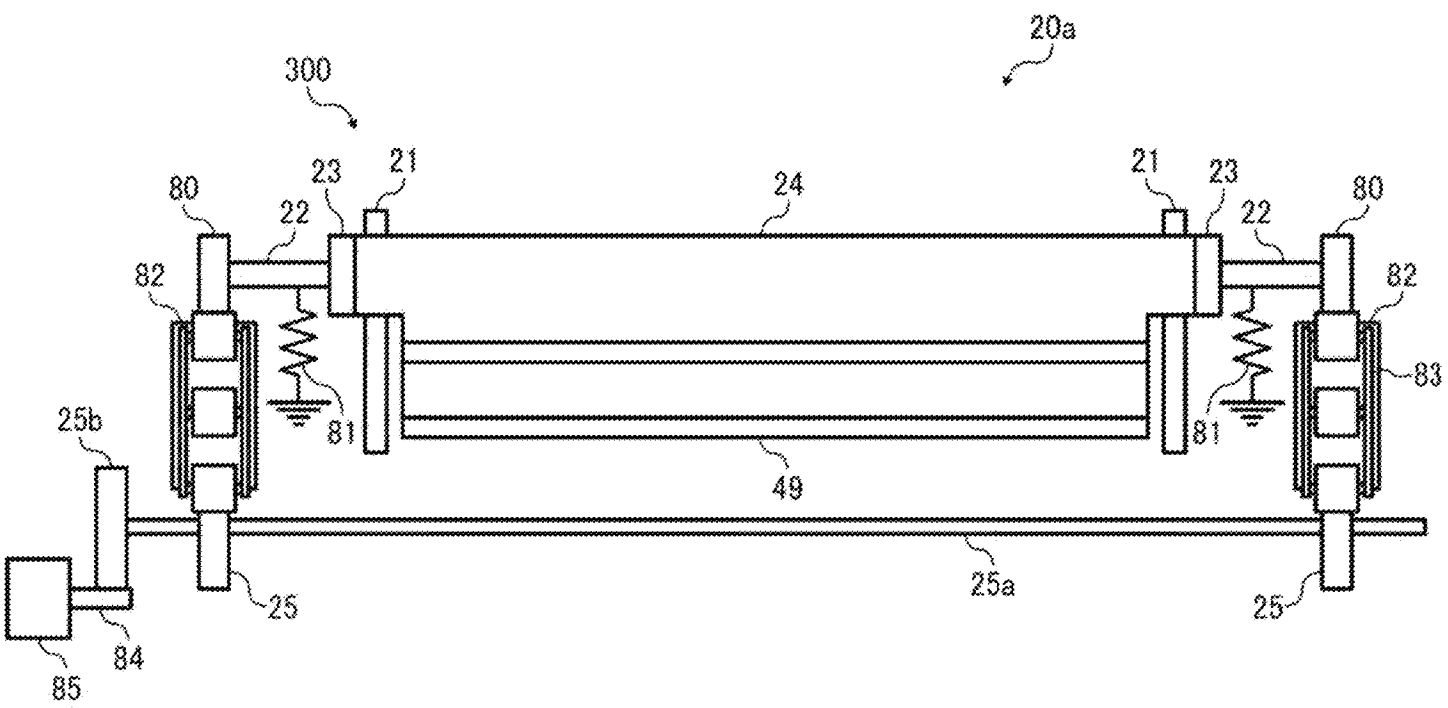
FIG. 21 is a schematic side view of the mover depicted in FIG. 20.

FIG. 20 is a schematic vertical cross-sectional view of the fixing device 40A, illustrating the mover 20*a* including a joint 83. FIG. 21 is a schematic side view of the mover 20*a* depicted in FIG. 20, seen from a downstream position disposed downstream from the mover 20*a* in the sheet conveyance direction DP.

As illustrated in FIG. 20, the cam 25 serving as a driving portion is disposed opposite the pressure roller 45 and disposed opposite the coupler 22 via the sheet conveyance region defined by the upper ejection guide 57*a* and the lower ejection guide 57*b*. The coupler 22 is attached with a driving force receiver 80 that contacts the joint 83 and receives a driving force from the cam 25.

The joint 83 includes three guide rollers 83*a* aligned in a direction perpendicular to the axial direction of the fixing roller 41 and the sheet conveyance direction DP with an identical gap between the adjacent guide rollers 83*a*. The guide rollers 83*a* are rotatably supported by a pair of roller support plates 83*b*. One of the three guide rollers 83*a* that is disposed opposite the coupler 22 contacts the driving force receiver 80 attached to the coupler 22. Another one of the three guide rollers 83*a* that is disposed opposite the cam 25 contacts the cam 25.

A pair of guide plates 82 guides the joint 83 vertically in FIG. 20. The three guide rollers 83*a* contact the pair of guide plates 82. As illustrated in FIG. 21, the cam 25 is mounted on each lateral end of the driving shaft 25*a* in the axial direction thereof. A gear 25*b* is mounted on a left lateral end of the driving shaft 25*a* in FIG. 21, which is situated at a rear end of the fixing device 40. The gear 25*b* meshes with a motor gear 84 mounted on a driving motor 85. One end of a spring 81 is anchored to the coupler 22. The spring 81 biases the coupler 22 toward the cam 25.

The joint 83 places the cam 25, serving as the driving portion, outside the sheet conveyance region defined by the upper ejection guide 57*a* and the lower ejection guide 57*b*, allowing the cam 25 to be mounted on each lateral end of the single driving shaft 25*a* in the axial direction thereof. Since the single driving shaft 25*a* mounts the two cams 25 at both lateral ends of the driving shaft 25*a* in the axial direction thereof, respectively, the single driving motor 85 coupled to one lateral end of the driving shaft 25*a* in the axial direction thereof drives the two cams 25. Accordingly, compared to a configuration in which separate driving motors drive the two cams 25, respectively, the driving motor 85 reduces the number of parts of the fixing device 40A. Additionally, the single driving shaft 25*a* mounting the cams 25 at both lateral ends of the driving shaft 25*a* in the axial direction thereof, respectively, drives and rotates the cams 25 simultaneously, suppressing warping of the support plate 24.

The cams 25 mounted on both lateral ends of the driving shaft 25*a* in the axial direction thereof lift the couplers 22 disposed opposite both lateral ends of the support plate 24 in a longitudinal direction thereof, respectively, suppressing warping of the support plate 24 compared to a configuration in which the cam 25 is mounted on one lateral end of the driving shaft 25*a* in the axial direction thereof such that the cam 25 lifts the coupler 22 disposed opposite one lateral end of the support plate 24 in the longitudinal direction thereof.

When the presser 49 moves from the contact position depicted in FIG. 20 to the isolation position, the controller 200 depicted in FIG. 11 drives the driving motor 85 to rotate the cams 25 in the rotation direction D25. The cams 25 lift the joints 83, respectively, in a direction D83 depicted in FIG. 20. Each of the joints 83 includes the plurality of guide rollers 83*a*. As the guide rollers 83*a* roll or slide over a surface of each of the guide plates 82, the joints 83 move in the direction D83. Thus, while each of the joints 83 is guided by the guide plates 82, each of the joints 83 moves smoothly in the direction D83.

Figure 22:
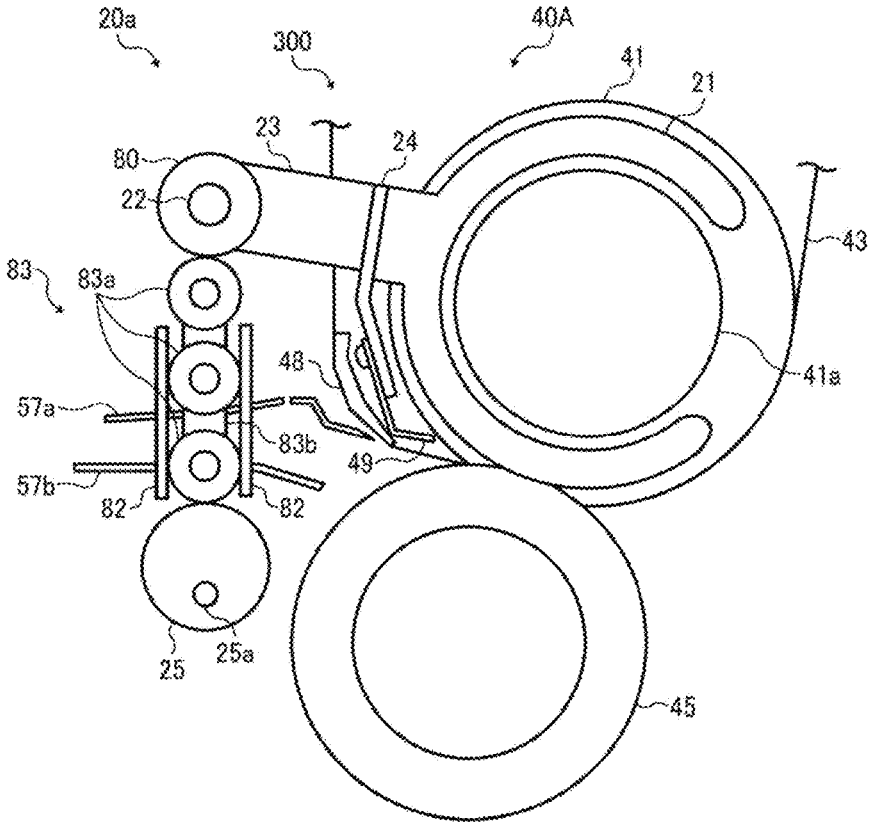
FIG. 22 is a schematic vertical cross-sectional view of the fixing device depicted in FIG. 20, illustrating the presser situated at the isolation position.

As the joints 83 move in the direction D83, each of the joints 83 lifts the driving force receiver 80 against a bias exerted by the spring 81. The support plate 24 supporting the presser 49 pivots about the rotation axis of the fixing roller 41 in a pivot direction A while the support plate 24 is guided by the guide 21. Accordingly as described above, the presser 49 moves to the isolation position depicted in FIG. 22 such that the presser 49 moves on the arcuate trajectory along the outer circumferential surface of the fixing roller 41. FIG. 22 is a schematic vertical cross-sectional view of the fixing device 40A, illustrating the isolation position of the presser 49.

As illustrated in FIG. 22, the mover 20*a* includes the arm 23 extending in a separation direction in which the arm 23 separates from the fixing roller 41. The tip portion of the arm 23 mounts the coupler 22 that receives a driving force transmitted from the cam 25. The coupler 22 is disposed outside the loop formed by the fixing belt 43. Compared to a configuration in which the coupler 22, that receives the driving force transmitted from the cam 25 directly or indirectly through the joint 83, is disposed inside the loop formed by the fixing belt 43, the coupler 22 is isolated from the fixing roller 41 with an increased interval therebetween.

The coupler 22 spaced apart from the fixing roller 41 attains advantages below. First, the coupler 22 suppresses deviation of the contact position and the isolation position of the presser 49 due to manufacturing error and assembly error. The mover 20*a* includes a support 300 constructed of the guide 21, the coupler 22, the arm 23, and the support plate 24. The support 300 supports the presser 49. As the support 300 pivots about the rotation axis of the fixing roller 41, the support 300 moves the presser 49. An amount of movement of the presser 49 moved by the support 300 pivoting about the rotation axis of the fixing roller 41 by an angle θ increases as the coupler 22 separates from the rotation axis of the fixing roller 41 farther. When the coupler 22 that receives the driving force transmitted from the cam 25 directly or indirectly through the joint 83 is shifted due to manufacturing error or assembly error, an amount of shifting of the presser 49 affected by an amount of shifting of the coupler 22 decreases as the coupler 22 separates from the fixing roller 41 farther.

Accordingly, compared to the configuration in which the coupler 22 is disposed inside the loop formed by the fixing belt 43, the coupler 22 disposed outside the loop formed by the fixing belt 43 reduces influence that shifting of the coupler 22 caused by manufacturing error or assembly error exerts on deviation of the contact position and the isolation position of the presser 49. Additionally, the controller 200 adjusts the contact position of the presser 49 precisely according to the pressing position of the pressure roller 45 where the pressure roller 45 is pressed against the fixing roller 41 via the fixing belt 43.

The side plate of the fixing device 40A is provided with a slot through which the coupler 22 penetrates. The slot supports the coupler 22 such that the coupler 22 is rotatable about the rotation axis of the fixing roller 41. The side plate of the fixing device 40A is further provided with a slot through which the driving shaft 25*a* penetrates such that the driving shaft 25*a* is supported by the slot and rotatable. If the fixing device 40A incorporates the mover 20*a* as illustrated in FIGS. 20 to 22, the side plate of the fixing device 40A is further provided with a slot that supports the guide plates 82 and the joint 83. The side plate of the fixing device 40A is further provided with a slot that supports the pressure roller 45 such that the pressure roller 45 comes into contact with and separates from the fixing belt 43. The side plate of the fixing device 40A is further provided with a slot that rotatably supports the fixing roller 41. Accordingly, if the coupler 22 is disposed inside the loop formed by the fixing belt 43, the slot supporting the coupler 22, the slot supporting the driving shaft 25*a*, and the slot supporting the guide plates 82 and the joint 83 are situated in proximity to the slot supporting the fixing roller 41 and the slot supporting the pressure roller 45. Consequently, the strength of the side plate may degrade, resulting in deformation of the side plate. If the side plate deforms, the rotation axis of the fixing roller 41 and the pressure roller 45 may tilt.

Conversely, if the coupler 22 is disposed outside the loop formed by the fixing belt 43, the slot supporting the coupler 22, the slot supporting the driving shaft 25*a*, and the slot supporting the guide plates 82 and the joint 83 are spaced apart from the slot supporting the fixing roller 41 and the slot supporting the pressure roller 45, suppressing degradation in the strength of the side plate. Thus, deformation of the side plate is suppressed, preventing the rotation axis of the fixing roller 41 and the pressure roller 45 from tilting.

The coupler 22 disposed outside the loop formed by the fixing belt 43 separates the spring 81 from a center of the fixing roller 41 in the axial direction thereof. The presser 49 is deformed resiliency and situated at the contact position. Accordingly, when the presser 49 is at the contact position, a restoring force of the presser 49 exerts a bias to the support 300 constructed of the guide 21, the coupler 22, the arm, 23, and the support plate 24. The bias pivots the support 300 in the pivot direction A depicted in FIGS. 18 and 20. The spring 81 biases the support 300 in a reverse direction opposite the pivot direction A depicted in FIGS. 18 and 20 to prevent the support 300 from being pivoted by the restoring force of the presser 49.

As indicated by a relation between moments of forces, as the coupler 22 separates farther from the rotation axis of the fixing roller 41 about which the support 300 pivots, a bias of the spring 81 that prevents the support 300 from being pivoted by the restoring force of the presser 49 in the pivot direction A decreases. Hence, compared to the configuration in which the coupler 22 is disposed inside the loop formed by the fixing belt 43, the coupler 22 disposed outside the loop formed by the fixing belt 43 decreases the bias of the spring 81. Accordingly, compared to the configuration in which the coupler 22 is disposed inside the loop formed by the fixing belt 43, the coupler 22 disposed outside the loop formed by the fixing belt 43 decreases a torque that moves the presser 49 from the contact position to the isolation position against the bias of the spring 81. Consequently, a downsized motor manufactured at reduced costs to attain a decreased output is employed as the driving motor 85.

A description is provided of a construction of a mover 20*b* as a second variation of the mover 20 depicted in FIGS. 11 and 12.

Figure 23:
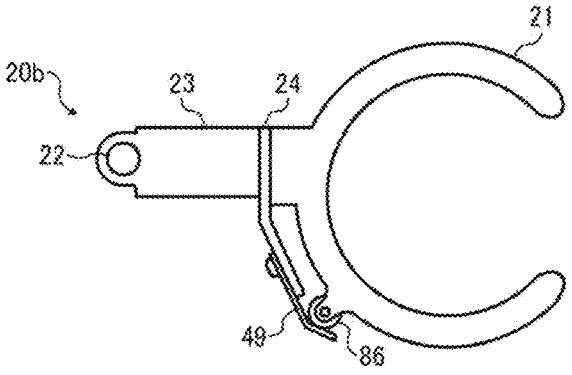
FIG. 23 is a partial schematic cross-sectional view of a mover as a second variation of the mover depicted in FIG. 11.
Figure 24:
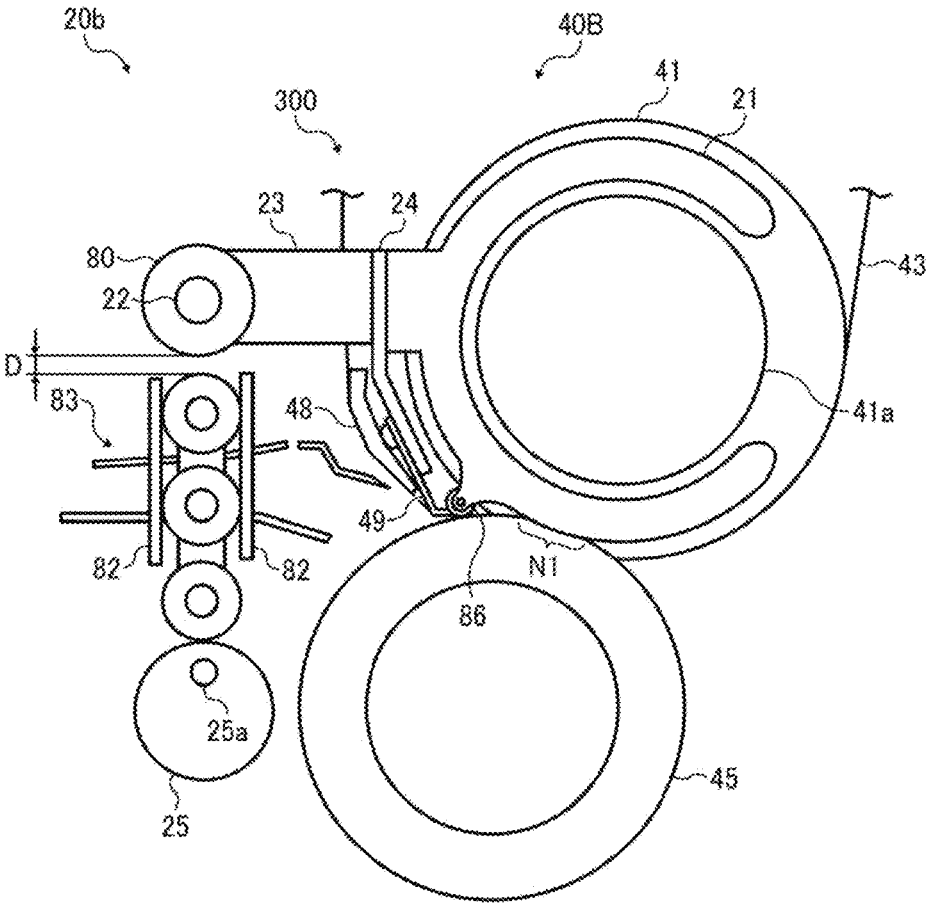
FIG. 24 is a partial schematic cross-sectional view of a fixing device incorporating the mover depicted in FIG. 23.

FIG. 23 is a partial schematic cross-sectional view of the mover 20*b*. FIG. 24 is a schematic cross-sectional view of a fixing device 40B incorporating the mover 20*b*, illustrating peripheral components of the fixing nip N1.

As illustrated in FIG. 23, the mover 20*b* includes a positioning roller 86 serving as a positioner that positions the presser 49 at the contact position. The positioning roller 86 is rotatably attached to the guide 21 disposed opposite each lateral end of the presser 49 in a longitudinal direction of the presser 49. As illustrated in FIG. 23, while the presser 49 is imposed with no load, the presser 49 projects beyond the positioning roller 86 radially. The positioning roller 86 is disposed outboard from the presser 49 in the longitudinal direction thereof and a conveyance span of the fixing belt 43 in the axial direction thereof where the sheet P is conveyed over the fixing belt 43. For example, the conveyance span corresponds to a width of a maximum size sheet in the a vial direction of the fixing belt 43, which is available in the fixing device 40B.

Figure 25:
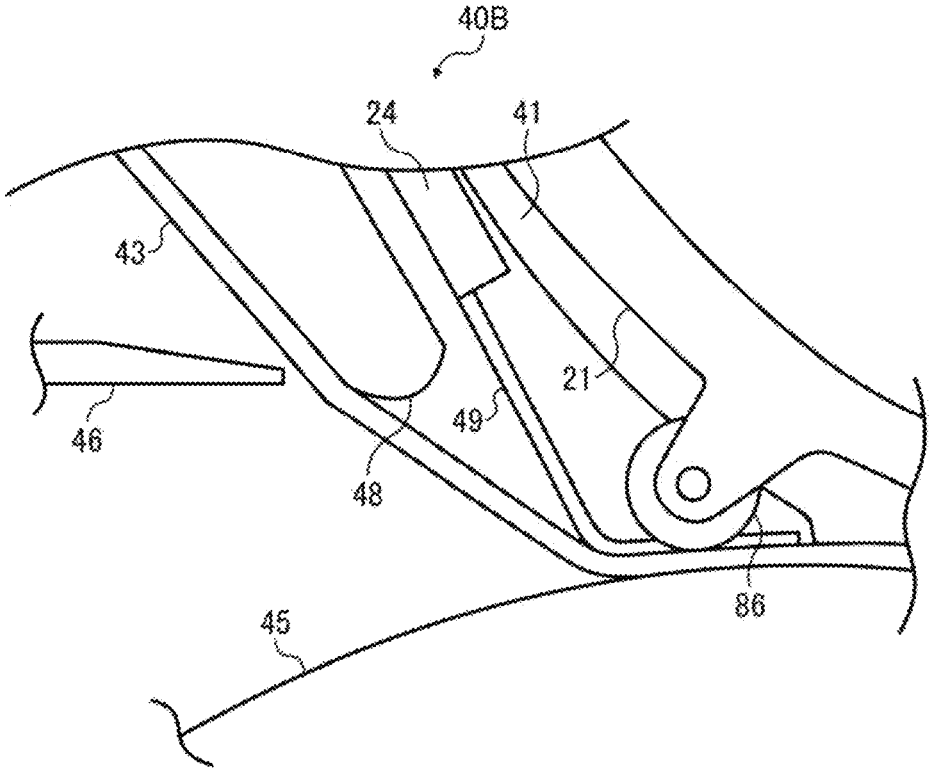
FIG. 25 is a partially enlarged cross-sectional view of the fixing device depicted in FIG. 24.

FIG. 25 is a partially enlarged cross-sectional view of the fixing device 40B incorporating the mover 20*b*, illustrating the peripheral components of the fixing nip N1. As illustrated in FIG. 25, as the positioning roller 86 presses against the pressure roller 45 via the fixing belt 43, the positioning roller 86 positions the presser 49 at the contact position. Thus, the presser 49 presses the fixing belt 43 against the pressure roller 45 with the predetermined pressure. Accordingly, the presser 49 suppresses waving of the sheet P precisely and reduces the load imposed on the fixing belt 43 and the pressure roller 45.

Additionally, since the positioning roller 86 is rotatable, the positioning roller 86 slides over the inner circumferential surface of the fixing belt 43 with a reduced resistance, that is, a reduced friction, suppressing abrasion of the fixing belt 43.

As described above, since the presser 49 projects beyond the positioning roller 86 radially while the presser 49 is imposed with no load, the presser 49 comes into contact with the fixing belt 43 to press the fixing belt 43 against the pressure roller 45 before the positioning roller 86 comes into contact with the fixing belt 43. As the presser 49 deforms resiliently, the positioning roller 86 presses against the pressure roller 45 via the fixing belt 43 and positions the presser 49 at the contact position. Pressure with which the positioning roller 86 presses against the pressure roller 45 via the fixing belt 43 is smaller than pressure with which the presser 49 presses against the pressure roller 45 via the fixing belt 43. A pressing area in which the tubular positioning roller 86 presses against the pressure roller 45 via the fixing belt 43 is smaller than a pressing area in which the platy presser 49 presses against the pressure roller 45 via the fixing belt 43. Accordingly, if the positioning roller 86 is disposed within the conveyance span of the fixing belt 43 in the axial direction thereof where the sheet P is conveyed over the fixing belt 43, the positioning roller 86 may not precisely press the sheet P against the pressure roller 45 in an opposed span of the sheet P in the axial direction of the fixing belt 43, that is disposed opposite the positioning roller 86, thus waving the sheet P in the opposed span of the sheet P.

Since the positioning roller 86 is tubular, the positioning roller 86 presses against the pressure roller 45 via the fixing belt 43 at a pressing position separated from the fixing nip N1 farther than a pressing position where the platy presser 49 presses against the pressure roller 45 via the fixing belt 43, thus increasing the border N2*s* in the rotation direction D43 of the fixing belt 43. Accordingly, if the positioning roller 86 is disposed within the conveyance span of the fixing belt 43 in the axial direction thereof where the sheet P is conveyed over the fixing belt 43, variation in gloss of the toner image T on the sheet P may occur in the opposed span of the sheet P in the axial direction of the fixing belt 43, that is disposed opposite the positioning roller 86.

To address this circumstance, according to this exemplary embodiment of the fixing device 40B, the positioning roller 86 is disposed outboard from the conveyance span of the fixing belt 43 in the axial direction thereof where the sheet P is conveyed over the fixing belt 43. Thus, the presser 49 presses the sheet P against the pressure roller 45 in an entire span of the sheet P in the axial direction of the fixing belt 43, suppressing waving of the sheet P precisely. In the conveyance span of the fixing belt 43 in the axial direction thereof where the sheet P is conveyed over the fixing belt 43, the positioning roller 86 decreases the border N2*s* in the sheet conveyance direction DP, suppressing variation in gloss of the toner image T on the sheet P.

Since a width of the fixing belt 43 is greater than a width of the pressure roller 45 in the axial direction of the fixing belt 43, the positioning roller 86 presses against the pressure roller 45 indirectly via the fixing belt 43. Alternatively, the positioning roller 86 may press against the pressure roller 45 directly. However, the positioning roller 86 pressing against the pressure roller 45 via the fixing belt 43 attains advantages below, if the positioning roller 86 contacts the pressure roller 45 directly, the presser 49 may deform resiliently while the fixing belt 43 rotates, rendering the fixing belt 43 to flap. Accordingly, the presser 49 may not keep pressing the fixing belt 43 against the pressure roller 45.

Conversely, if the positioning roller 86 presses against the pressure roller 45 via the fixing belt 43, the positioning roller 86 is to be lifted to flap the fixing belt 43. In order to lift the positioning roller 86, the support 300 constructed of the guide 21, the coupler 22, the arm, 23, and the support plate 24 is to be pivoted against the bias exerted by the spring 81. As described above, the spring 81 biases the support 300 in the reverse direction opposite the pivot direction A depicted in FIGS. 18 and 20 to prevent the support 300 from being pivoted by the restoring force of the presser 49. Hence, pressure greater than pressure that deforms the presser 49 resiliency is to be exerted to the positioning roller 86 to lift the positioning roller 86. Accordingly, compared to the positioning roller 86 pressing against the pressure roller 45 directly, the positioning roller 86 pressing against the pressure roller 45 via the fixing belt 43 suppresses flapping of the fixing belt 43 more effectively.

When the positioning roller 86 positions the presser 49 at the contact position as illustrated in FIG. 24, the joint 83 separates from the driving force receiver 80 with an interval D between the joint 83 and the driving force receiver 80. Accordingly, even with slight manufacturing error or slight assembly error, the mover 20*b* presses the positioning roller 86 against the pressure roller 45 precisely, thus positioning the presser 49 at the contact position properly.

Since the interval D is provided between the joint 83 and the driving force receiver 80, the controller 200 changes the contact position of the presser 49 in accordance with change of the pressing portion of the pressure roller 45 without driving the cam 25. For example, when the pressing position of the pressure roller 45 separates from the fixing roller 41 farther than the reference pressing position, the bias of the spring 81 pivots the support 300 counterclockwise from a position illustrated in FIG. 34. Accordingly, the presser 49 moves from the reference contact position to the proximal contact position. Conversely, when the pressing position of the pressure roller 45 is the proximal pressing position where the pressure roller 45 is closer to the fixing roller 41 than at the reference pressing position, the pressure roller 45 lifts the positioning roller 86, pivoting the support 300 clockwise in FIG. 24. Accordingly, the contact position of the presser 49 changes from the reference contact position depicted in FIG. 24 to the distal contact position that is separated from the pressure roller 45 farther than the reference contact position. Thus, the mover 20*b* includes a presser position adjuster constructed of the positioning roller 86, the joint 83, and the driving force receiver 80. The joint 83 and the driving force receiver 80 define the interval D.

The above describes the exemplary embodiments of the fixing devices 40, 40S, 40T, 40A, and 40B installed in the image forming apparatus 1000 such as a copier, a printer, a facsimile machine, and an MFP that forms a toner image T on a sheet P by electrophotography. Alternatively, the exemplary embodiments of the fixing devices 40, 40S, 40T, 40A, and 40B may be applied to a fixing device that dries an ink image formed on a sheet with ink and is installed in an image forming apparatus such as a copier, a printer, a facsimile machine, and an MFP that forms an ink image on a sheet by an inkjet printing system, for example.

The exemplary embodiments described above are one example of a fixing device (e.g., the fixing devices 40, 40S, 40T, 40A, and 40B) and attain advantages below in a plurality of aspects 1 to 17.

A description is provided of advantages of the fixing device in the aspect 1.

As illustrated in FIGS. 2, 5, 6, 7, 11, 15, 18, and 24, the fixing device includes a fixing belt (e.g., the fixing belt 43), a nip former (e.g., the fixing roller 41), a pressure rotator (e.g., the pressure roller 45), a heater (e.g., the heater 44), a separator (e.g., the separation aid 48), a presser (e.g., the presser 49), a pressure adjuster (e.g., the pressurization assembly 201), and a presser position adjuster (e.g., the movers 20, 20*a*, and 20*b*).

The fixing belt 43 is an endless belt stretched taut across a plurality of stretchers (e.g., the fixing roller 41 and the heating roller 42) and rotatable in a rotation direction (e.g., the rotation direction D43). The fixing roller 41 serves as a nip former and one of the plurality of stretchers that stretches the fixing belt. The pressure roller 45 serves as a pressure rotator disposed opposite the nip former and pressed against the nip former via the fixing belt to form a fixing nip (e.g., the fixing nip N1) between the fixing belt and the pressure rotator. A recording medium (e.g., a sheet P) bearing a toner image (e.g., a toner image T) is conveyed through the fixing nip. The heater 44 serves as a heater that heats the fixing belt. The separation aid 48 serves as a separator disposed downstream from the nip former in a recording medium conveyance direction (e.g., the sheet conveyance direction DP). The separator is isolated from the pressure rotator via the fixing belt. The fixing belt is looped over and stretched by the separator. The presser 49 serves as a presser interposed between an exit (e.g., the exit N1*e*) of the fixing nip and an upstream end (e.g., an upstream end 48*c*) of the separator in the rotation direction of the fixing belt. The presser comes into contact with an inner circumferential surface of the fixing belt to press the fixing belt against the pressure rotator.

As illustrated in FIG. 15, the pressurization assembly 201 serves as a pressure adjuster that contacts the pressure rotator and changes a pressing position of the pressure rotator relative to the fixing belt to adjust pressure exerted from the pressure rotator to the fixing belt. The presser position adjuster contacts the presser and changes a presser position of the presser relative to the fixing belt according to the pressing position of the pressure rotator.

A description is provided of a construction of a comparative fixing device.

The comparative fixing device includes a fixing belt heated by a heater and stretched taut across a plurality of stretchers. A pressure rotator (e.g., a pressure roller) is pressed against a nip former (e.g., a fixing roller), serving as one of the plurality of stretchers, via the fixing belt to form a fixing nip between the fixing belt and the pressure rotator while the pressure rotator rotates. As a recording medium bearing a toner image is conveyed through the fixing nip, the fixing belt and the pressure rotator fix the toner image on the recording medium.

A separation mechanism separates the recording medium having passed through the fixing nip from the fixing belt. For example, the separation mechanism includes a separation claw disposed downstream from the fixing nip in a recording medium conveyance direction. A front end of the separation claw is disposed opposite an outer circumferential surface of the fixing belt with a predetermined gap therebetween. A separator contacts an inner circumferential surface of the fixing belt to increase a curvature of an opposed portion of the fixing belt that is disposed opposite the separation claw. In other words, the separator decreases a radius of curvature of the opposed portion of the fixing belt. The separator is isolated from the pressure rotator via the fixing belt.

After the recording medium passes through the fixing nip, the recording medium may wave. While the waved recording medium is conveyed by the output roller pair 52 depicted in FIG. 1, streaked creases may be produced on the recording medium. The recording medium having passed through the fixing nip may wave while the recording medium moves from an exit of the fixing nip to a separation position where the separator separates the recording medium from the fixing belt.

Waving of the recording medium may occur in the comparative fixing device due to reasons described below. As an image side of a recording medium that bears an unfixed toner image is heated by the fixing belt under pressure while the recording medium in conveyed through the fixing nip, toner of the toner image is melted and fixed on the recording medium. After the recording medium is ejected from the fixing nip, the recording medium is conveyed to the separatism position where the separator separates the recording medium from the fixing belt in a state in which the melted toner of the toner image on the recording medium adheres to the fixing belt. When the recording medium reaches the separation position, the separator separates the recording medium from the fixing belt. As the recording medium is heated by the fixing belt at the fixing nip, moisture contained in the recording medium is vaporized into steam. However, since the fixing belt and the pressure rotator sandwich the recording medium with substantial pressure at the fixing nip, steam is not discharged from the recording medium easily.

Conversely, while the recording medium is conveyed from the fixing nip to the separation position in the state in which the melted toner of the toner image on the recording medium adheres to the fixing belt, since the recording medium receives no pressure, steam generated at the fixing nip is discharged from the recording medium easily. Steam is mainly discharged from a back side of the recording medium that is disposed opposite the pressure rotator.

A height of a non-image section on the recording medium that does not bear the toner image is smaller than a height of an image section on the recording medium that bears the toner image. Accordingly, a gap is produced between the fixing belt and the non-image section on the recording medium. Steam is discharged from the recording medium to the gap also. As the recording medium discharges steam, fiber of the recording medium dries. Accordingly, the recording medium shrinks and waves.

Steam discharged to the gap between the fixing belt and the non-image section on the recording medium remains in the gap. Steam is reabsorbed by the recording medium. As the recording medium reabsorbs steam discharged therefrom and moistens, fiber of the recording medium stretches. Accordingly, the recording medium waves.

While the recording medium moves from the fixing nip to the separation position, fiber of the recording medium suffers from contraction as the recording medium discharges steam and dries and expansion as the recording medium reabsorbs steam and moistens. Accordingly, the recording medium waves.

To address this circumstance, in the aspect 1 of the fixing device, the presser presses the fixing belt against the pressure rotator so that the recording medium ejected from the fixing nip is conveyed in a state in which the recording medium is sandwiched between the fixing belt and the pressure rotator or in a state in which a gap is barely produced between the recording medium and the pressure rotator, thus attaining advantages below. While the recording medium moves from the fixing nip to the separation position, even if the recording medium is susceptible to waving after the recording medium discharges steam and dries, the recording medium contacts the fixing belt and the pressure rotator that prevent the recording medium from waving. Consequently, even while the recording medium moves from the fixing nip to the separator, the presser prevents the recording medium from waving due to discharging of steam.

Additionally, while the recording medium moves from the fixing nip to the separator, even if the recording medium is susceptible to waving as the recording medium reabsorbs steam discharged therefrom, the fixing belt and the pressure rotator prevent the recording medium from waving. Accordingly, even while the recording medium moves from the fixing nip to the separation position, the presser prevents the recording medium from waving due to reabsorption of steam.

After the recording medium passes through the fixing nip, the presser suppresses waving of the recording medium, preventing the waved recording medium from being conveyed by the output roller pair 52 depicted in FIG. 1 and therefore preventing streaked creases from being produced on the recording medium.

As illustrated in FIG. 15, the pressure adjuster changes the pressing position of the pressure rotator relative to the fixing belt according to the type of the recording medium, thus adjusting pressure exerted from the pressure rotator to the fixing belt. For example, while an envelope is conveyed through the fixing device, the pressure adjuster moves the pressure rotator to a distal pressing position where a rotation axis of the pressure rotator separates from the fixing belt farther than at a reference pressing position, thus decreasing pressure exerted from the pressure rotator to the fixing belt. However, if the pressure rotator moves to the distal pressing position to decrease pressure exerted from the pressure rotator to the fixing belt, pressure exerted from the presser to the recording medium may decrease. Accordingly, the presser may not suppress waving of the recording medium precisely.

To address this circumstance, in the aspect 1, the presser position adjuster changes the presser position of the presser relative to the fixing belt according to the pressing position of the pressure rotator. The presser position adjuster changes the presser position of the presser relative to the fixing belt according to the pressing position of the pressure rotator so that the presser presses the fixing belt against the pressure rotator with constant pressure. Accordingly, even if the pressure adjuster changes the pressing position of the pressure rotator, the presser suppresses waving of the recording medium after the recording medium is ejected from the fixing nip and thereby prevents streaked creases from being produced on the recording medium after the recording medium is ejected from the output roller pair 52.

A description is provided of advantages of the fixing device in the aspect 2.

According to the aspect 1, the presser separably contacts the fixing belt. As illustrated in FIGS. 11 and 12, a controller (e.g., the controller 200) controls the presser position adjuster, based on a type of the recording medium conveyed toward the fixing nip or the like, to determine whether or not to cause the prefer position adjuster to separate the presser from the fixing belt, for example, to move the presser to one of a contact position where the presser brings the fixing belt into contact with the pressure rotator or the presser presses the fixing belt against the pressure rotator and an isolation position where the presser isolates the fixing belt from the pressure rotator.

Accordingly, if the recording medium is a type of a sheet (e.g., an OHP transparency and thick paper) that is not susceptible to waving as the recording medium discharges and reabsorbs steam while the recording medium is conveyed to a separation position where the separator separates the recording medium from the fixing belt, the controller controls the presser position adjuster to move the presser to the isolation position where the presser isolates the fixing belt from the pressure rotator. Consequently, the presser reduces a load imposed by the presser on the fixing belt and the pressure rotator, improving durability of the fixing belt and the pressure rotator. Additionally, the presser position adjuster reduces friction between the presser and the inner circumferential surface of the fixing belt, suppressing abrasion of the inner circumferential surface of the fixing belt.

Conversely, if the recording medium is a type of a sheet that is susceptible to waving such as thin paper while the recording medium is conveyed to the separation positions where the separator separates the recording medium from the fixing belt, the presser position adjuster moves the presser to the contact position where the presser presses the fixing belt and the recording medium against the pressure rotator while the recording medium is conveyed through the fixing device. For example, the presser position adjuster moves the presser to the reference contact position, the proximal contact position, or the distal contact position. Consequently, the presser position adjuster prevents the recording medium from waving while the recording medium is conveyed to the separation position where the separator separates the recording medium from the fixing belt.

The controller controls the presser position adjuster, based on the type of the recording medium conveyed toward the fixing nip or the like, to move the presser to one of the contact position and the isolation position. Thus, the controller suppresses waving of the recording medium and reduces the load imposed on the fixing belt and the pressure rotator.

A description is provided of advantages of the fixing device in the aspect 3.

According to the aspect 1 or 2, the presser separably contacts the fixing belt. The controller determines whether or not to separate the presser from the fixing belt based on the type of the recording medium to be conveyed to the fixing nip and an amount of heat to be conducted to the fixing belt to fix the toner image on the recording medium.

Accordingly, as described above in the exemplary embodiments, if a substantial amount of heat is to be conducted to the fixing belt to fix the toner image on the recording medium, even if the recording medium is a type of a sheet (e.g., an OHP transparency and thick paper) that is not susceptible to waving, the controller controls the presser position adjuster to move the presser to the contact position where the presser presses the fixing belt and the recording medium against the pressure rotator. Hence, even after the recording medium passes through the fixing nip, the presser retains the fixing belt in contact with the recording medium. Thus, the fixing belt heats the toner image on the recording medium even after the recording medium passes through the fixing nip.

Since the presser is at the contact position where the presser presses the fixing belt and the recording medium against the pressure roller, even after the recording medium is ejected from the fixing nip, the recording medium is conveyed while the recording medium is sandwiched between the fixing belt and the pressure rotator with pressure exerted from the presser. Accordingly, even after the recording medium is ejected from the fixing nip, the fixing belt and the pressure rotator fix the toner image on the recording medium under heat and pressure. Hence, even if the substantial amount of heat is needed to fix the toner image on the recording medium, the fixing belt and the pressure rotator fix the toner image on recording medium properly.

Conversely, if the recording medium is a type of a sheet (e.g., an OHP transparency and thick paper) that is not susceptible to waving and a decreased amount of heat is needed to fix the toner image on the recording medium, the controller controls the presser position adjuster to move the presser to the isolation position where the presser isolates from the fixing belt. Accordingly, the presser reduces a load imposed by the presser on the fixing belt and the pressure rotator, improving durability of the fixing belt and the pressure rotator. Additionally, the presser position adjuster reduces friction between the presser and the inner circumferential surface of the fixing belt, suppressing abrasion of the inner circumferential surface of the fixing belt.

A description is provided of advantages of the fixing device in the aspect 4.

According to the aspect 2, if the recording medium to be conveyed to the fixing nip has a paper weight not smaller than 164 [gsm], the controller controls the presser position adjuster to separate the presser from the fixing belt. Thus, as described above in the exemplary embodiments, the controller suppresses waving of the recording medium and reduces the load imposed on the fixing belt and the pressure rotator.

A description is provided of advantages of the fixing device in the aspect 5.

According to the aspect 3, if the recording medium to be conveyed to the fixing nip has a paper weight not smaller than 164 [gsm], the controller determines whether or not to separate the presser from the fixing belt according to the amount of heat to be conducted to the fixing belt to fix the toner image on the recording medium.

Accordingly, as described above in the exemplary embodiments, the fixing belt and the pressure rotator fix the toner image on the recording medium properly. Thus, the controller suppresses waving of the recording medium and reduces the load imposed on the fixing belt and the pressure rotator.

A description is provided of advantages of the fixing device in the aspect 6.

According to the aspect 2 or 4, the controller includes a memory (e.g., the memory 200*a*) to store information based on which the controller determines whether or not to separate the presser from the fixing belt. The information varies depending on the type of the recording medium. Thus, as described above in the exemplary embodiments, the controller suppresses waving of the recording medium and reduces the load imposed on the fixing belt and the pressure rotator.

A description is provided of advantages of the fixing device in the aspect 7.

According to any one of the aspects 1 to 6, the presser separably contacts the fixing belt. While the recording medium is not conveyed through the fixing nip, the controller controls the presser position adjuster to separate the presser from the fixing belt.

Accordingly, as described above in the exemplary embodiments, compared to a configuration in which the presser presses the fixing belt against the pressure rotator constantly, the presser reduces the load imposed by the presser on the fixing belt and the pressure rotator, improving durability of the fixing belt and the pressure rotator.

A description is provided of advantages of the fixing device in the aspect 8.

According to any one of the aspects 1 to 7, the presser position adjuster includes a cam (e.g., the cam 25). As the cam rotates, the cam changes the presser position of the presser relative to the fixing belt.

Accordingly, as described in the exemplary embodiments, the presser position adjuster changes a rotation angle of the cam according to the pressing position of the pressure rotator. Thus, the presser position adjuster adjusts the contact position of the presser, for example, between the reference contact position, the proximal contact position, and the distal contact position.

A description is provided of advantages of the fixing device in the aspect 9.

According to any one of the aspects 1 to 8, as illustrated in FIG. 5, the fixing device further includes a secondary separator (e.g., the separation plate 46) including a front edge (e.g., the front edge 46*a*) isolated from an outer circumferential surface of the fixing belt and disposed opposite the separator. A rigidity of the separator is greater than a rigidity of the presser.

Accordingly, as described above in the exemplary embodiments, deformation of the separator is suppressed. Change in a slight interval (e.g., the interval d) between the secondary separator and the fixing belt is suppressed. Accordingly, the fixing belt does not come into contact with the front end of the secondary separator and therefore the secondary separator does not damage the outer circumferential surface of the fixing belt. Additionally, a leading edge of the recording medium in the recording medium conveyance direction, even if the recording medium adheres to the fixing belt, does not come into contact with the secondary separator, suppressing separation failure of the secondary separator.

A description is provided of advantages of the fixing device in the aspect 10.

According to any one of the aspects 1 to 9, as illustrated in FIG. 5, the separator includes a contact face (e.g., a contact face 48*f*) that is arcuate in cross-section and in contact with the fixing belt.

Accordingly, as described above in the exemplary embodiments, the fixing belt slides over the arcuate contact face of the separator smoothly.

A description is provided of advantages of the fixing device in the aspect 11.

According to any one of the aspects 1 to 10, the presser brings the fixing belt into contact with the pressure rotator. The presser is made of a resilient plate.

Accordingly, as described above in the exemplary embodiments, compared to a configuration in which the presser is a block, the presser made of the resilient plate attains a reduced thermal capacity. Thus, the presser draws less heat from the fixing belt and thereby suppresses waste of heat. Accordingly, compared to the presser made of the block, the presser made of the plate shortens a waiting time for a user to wait until the fixing belt is heated to a target temperature. Additionally, compared to the configuration in which the presser is the block, the presser made of the plate suppresses power consumption, saving energy.

Since the presser is resilient, the presser deforms readily to curve along an outer circumferential surface of the pressure rotator precisely, thus pressing the fixing belt against the pressure rotator precisely.

A description is provided of advantages of the fixing device in the aspect 12.

According to the aspect 11, as illustrated in FIG. 5, the presser includes a pressing portion (e.g., the pressing portion 49*b*) and a peel-off portion (e.g., the peel-off portion 49*a*). The pressing portion comes into contact with the inner circumferential surface of the fixing belt to press the fixing belt against the pressure rotator. The peel-off portion is disposed downstream from the pressing portion in the rotation direction of the fixing belt or the recording medium conveyance direction. The peel-off portion is bent in a separation direction in which the peel-off portion separates from the pressure rotator.

Accordingly, the pressing portion presses the recording medium against the pressure rotator properly. The fixing belt sandwiched between the pressing portion and the pressure rotator moves along the bent peel-off portion that changes the rotation direction of the fixing belt sharply. Thus, the peel-off portion defines a curvature of the fixing belt that separates the recording medium from the fixing belt. Consequently, the recording medium is separated from the fixing belt precisely at a plurality of positions on the fixing belt by the curvature of the fixing belt that is defined by the peel-off portion and the curvature of the fixing belt that is defined by the separator.

A description is provided of advantages of the fixing device in the aspect 13.

According to the aspect 11 or 12, the presser includes the pressing portion that comes into contact with the inner circumferential surface of the fixing belt to bring the fixing belt into contact with the pressure rotator. The pressing portion is contoured along the outer circumferential surface of the pressure rotator.

Hence, as described above in the exemplary embodiments, the presser presses the fixing belt against the pressure rotator evenly. Accordingly, air bubbles disposed between the recording medium and the fixing belt and the like are not pushed to a pressurization span such as a post nip (e.g., the post nip N2) where the presser presses the fixing belt against the pressure rotator and do not move over a surface of the recording medium. Consequently, the presser suppresses formation of a faulty toner image having variation in gloss or the like at the post nip.

A description is provided of advantages of the fixing device in the aspect 14.

According to any one of the aspects 11 to 13, as illustrated in FIG. 5, an upstream end (e.g., the upstream end 49*j*) of the presser in the rotation direction of the fixing belt is a free end.

Accordingly, as described in the exemplary embodiments, since the presser is disposed in proximity to the fixing nip, the presser decreases a border (e.g., the border N2*s*) interposed between the fixing nip and the pressurization span such as the post nip where the presser presses the fixing belt against the pressure rotator in the recording medium conveyance direction, thus suppressing variation in gloss of the toner image on the recording medium.

A description is provided of advantages of the fixing device in the aspect 15.

According to any one of the aspects 1 to 14, a distance between the exit of the fixing nip and the upstream end of the presser in the rotation direction of the fixing belt, is not greater than 2.8 mm.

Accordingly, as described in the exemplary embodiments, the presser suppresses decrease in surface pressure at the border interposed between the fixing nip and the pressurization span such as the post nip where the presser presses the fixing belt against the pressure rotator in the recording medium conveyance direction, thus suppressing variation in gloss of the toner image on the recording medium.

A description is provided of advantages of the fixing device in the aspect 16.

According to any one of the aspects 1 to 15, the presser includes an upstream portion (e.g., the upstream end 49*j*) and a downstream portion (e.g., the intermediate portion 49*i*) disposed downstream from the upstream portion in the rotation direction of the fixing belt. Pressure exerted by the downstream portion to the fixing belt is not greater than pressure exerted by the upstream portion to the fixing belt.

Accordingly, as described in the exemplary embodiments, the pressurization span such as the post nip where the presser presses the fixing belt against the pressure rotator suppresses variation in gloss of the toner image on the recording medium.

A description is provided of advantages of the fixing device in the aspect 17.

As illustrated in FIG. 1, an image forming apparatus (e.g., the image forming apparatus 1000) includes an image bearer (e.g., the photoconductors 3Y, 3M, 3C, and 3K), an image forming device (e.g., the image forming units 2Y, 2M, 2C, and 2K), a transfer device (e.g., the primary transfer unit 60 and the secondary transfer unit 78), and a fixing device (e.g., the fixing devices 40, 40S, 40T, 40A, and 40B) according to any one of the aspects 1 to 16.

The image forming device forms a toner image on the image bearer and includes the charger 5, the optical writing unit 1, and the developing device 4. The transfer device transfers the toner image formed on the image bearer onto a recording medium (e.g., a sheet P). The fixing device fixes the toner image on the recording medium.

The image forming apparatus incorporating the fixing device suppresses flapping of the fixing belt and prevents streaked creases from being produced on the recording medium bearing the fixed toner image.

According to the exemplary embodiments described above, the fixing belt 43 serves as a fixing belt. Alternatively, a fixing film, a fixing sleeve, or the like may be used as a fixing belt. Further, the pressure roller 45 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium bearing a toner image is conveyed;

a separator disposed downstream from the nip former in a recording medium conveyance direction and isolated from the pressure rotator via the fixing belt, the separator stretching the fixing belt;

a presser, interposed between an exit of the fixing nip and an upstream end of the separator in the rotation direction of the fixing belt, to come into contact with an inner circumferential surface of the fixing belt to press the fixing belt against the pressure rotator;

a pressure adjuster, contacting the pressure rotator, to change a pressing position of the pressure rotator relative to the fixing belt to adjust pressure exerted from the pressure rotator to the fixing belt; and a presser position adjuster, contacting the presser, to change a presser position of the presser relative to the fixing belt according to the pressing position of the pressure rotator, wherein the presser separably contacts the fixing belt, the fixing device further comprising a controller to determine whether or not to cause the presser position adjuster to separate the presser from the fixing belt based on a type of the recording medium conveyed toward the fixing nip, wherein the controller determines whether or not to cause the presser position adjuster to separate the presser from the fixing belt based on an amount of heat to be conducted to the fixing belt to fix the toner image on the recording medium.

2. An image forming apparatus comprising:

an image forming device to form a toner image; and a fixing device disposed downstream from the image forming device in a recording medium conveyance direction to fix the toner image on a recording medium, the fixing device including:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which the recording medium bearing the toner image is conveyed;

a separator disposed downstream from the nip former in the recording medium conveyance direction and isolated from the pressure rotator via the fixing belt, the separator stretching the fixing belt;

a presser, interposed between an exit of the fixing nip and an upstream end of the separator in the rotation direction of the fixing belt, to come into contact with an inner circumferential surface of the fixing belt to press the fixing belt against the pressure rotator;

a pressure adjuster, contacting the pressure rotator, to change a pressing position of the pressure rotator relative to the fixing belt to adjust pressure exerted from the pressure rotator to the fixing belt; and a presser position adjuster, contacting the presser, to change a presser position of the presser relative to the fixing belt according to the pressing position of the pressure rotator, wherein the presser separably contacts the fixing belt, the fixing device further comprising a controller to determine whether or not to cause the presser position adjuster to separate the presser from the fixing belt based on a type of the recording medium conveyed toward the fixing nip, wherein the controller determines whether or not to cause the presser position adjuster to separate the presser from the fixing belt based on an amount of heat to be conducted to the fixing belt to fix the toner image on the recording medium.

3. The fixing device according to claim 1, wherein the controller determines whether or not to cause the presser position adjuster to separate the presser from the fixing belt based on the amount of heat to be conducted to the fixing belt to fix the toner image on the recording medium if the recording medium conveyed toward the fixing nip has a paper weight not smaller than 164 gsm.

4. The fixing device according to claim 1, wherein the controller controls the presser position adjuster to separate the presser from the fixing belt if the recording medium conveyed toward the fixing nip has a paper weight not smaller than 164 gsm.

5. The fixing device according to claim 1, wherein the controller includes a memory to store information based on which the controller determines whether or not to cause the presser position adjuster to separate the presser from the fixing belt, the information varying depending on the type of the recording medium.

6. The fixing device according to claim 1, wherein the controller controls the presser position adjuster to separate the presser from the fixing belt while the recording medium is not conveyed through the fixing nip.

7. The fixing device according to claim 1, wherein the presser position adjuster includes a cam to rotate to change the presser position of the presser.

8. The fixing device according to claim 1, further comprising a secondary separator including a front end isolated from an outer circumferential surface of the fixing belt and disposed opposite the separator, wherein rigidity of the separator differs from the secondary separator in that the rigidity of the separator is greater than that of the presser.

9. The fixing device according to claim 1, wherein the separator includes a contact face that is arcuate in cross-section and in contact with the fixing belt.

10. The fixing device according to claim 1, wherein the presser includes a resilient plate.

11. The fixing device according to claim 10, wherein the presser further includes:

a pressing portion to come into contact with the inner circumferential surface of the fixing belt to press the fixing belt against the pressure rotator; and a peel-off portion disposed downstream from the pressing portion in the rotation direction of the fixing belt and bent in a separation direction in which the peel-off portion separates from the pressure rotator.

12. The fixing device according to claim 11, wherein the pressing portion is contoured along an outer circumferential surface of the pressure rotator.

13. The fixing device according to claim 10, wherein the presser further includes an upstream end in the rotation direction of the fixing belt, the upstream end being a free end.

14. The fixing device according to claim 13, wherein a distance between the exit of the fixing nip and the upstream end of the presser in the rotation direction of the fixing belt is not greater than 2.8 mm.

15. The fixing device according to claim 13, wherein the presser further includes a downstream portion disposed downstream from the upstream end of the presser in the rotation direction of the fixing belt, and wherein pressure exerted by the downstream portion of the presser to the fixing belt is not greater than pressure exerted by the upstream end of the presser to the fixing belt.

16. The fixing device according to claim 1, wherein the presser position adjuster changes the presser position such that the presser position is further from the fixing belt when using a thicker recording medium than when using a thinner recording medium.

17. The fixing device according to claim 16, wherein the presser position adjuster changes the presser position such that the presser position is further from the fixing belt when using a thicker recording medium than when using a thinner plain paper as a recording medium.

* * * * *